US005626085A

United States Patent [19]

Donais et al.

[11] Patent Number: 5,626,085

[45] Date of Patent: May 6, 1997

[54] CONTROL OF STAGED COMBUSTION, LOW $NO_X$ FIRING SYSTEMS WITH SINGLE OR MULTIPLE LEVELS OF OVERFIRE AIR

[75] Inventors: Richard E. Donais, West Suffield; Todd D. Hellewell, Windsor; Paul D. Kuczma, Enfield; Jonathan S. Simon, Barkhamsted, all of Conn.

[73] Assignee: Combustion Engineering, Inc., Windsor, Conn.

[21] Appl. No.: 578,254

[22] Filed: Dec. 26, 1995

[51] Int. Cl.[6] ..... F23N 5/18

[52] U.S. Cl. ..... 110/188; 110/101 C; 110/189; 110/263; 122/4 D

[58] Field of Search ..... 110/101 C, 189, 110/245, 263, 264, 345, 346, 348, 188; 431/173; 122/4 D

[56] References Cited

U.S. PATENT DOCUMENTS 5,195,450 3/1993 Marion ..... 110/347

5,315,939 5/1994 Rini et al. ..... 110/264

5,488,916 2/1996 Bozzuto ..... 110/347

*Primary Examiner*—Henry A. Bennett

*Assistant Examiner*—Pamela A. O'Connor

*Attorney, Agent, or Firm*—Arthur E. Fournier, Jr.

[57] ABSTRACT

A control system for a fuel-fired furnace and more specifically the control of the stoichiometric ratio of the combustion process occurring within the furnace of a steam generating power plant. The control system, when so employed, is capable of regulating the distribution of air flow to the combustion process such that the formation of oxides of nitrogen are maintained at acceptable levels. The control system includes in general a stoichiometric subsystem that determines the mass flow rate of air required to maintain the stoichiometric ratio within the combustion process; an override protection subsystem which ensures control precedence of the windbox-to-furnace pressure differential over the stoichiometry subsystem; and an overfire air subsystem that acts to apportion air flow amongst the various levels of overfire air within the boiler.

19 Claims, 13 Drawing Sheets

CONTROL OF STAGED COMBUSTION, LOW $NO_X$ FIRING SYSTEMS WITH SINGLE OR MULTIPLE LEVELS OF OVERFIRE AIR

BACKGROUND OF THE INVENTION

This invention relates to a control system for a fuel fired furnace and more specifically to the control of the stoichiometric ratio within the combustion process occurring within the furnace of a steam generating power plant. Control of the stoichiometric ratio is accomplished by regulating the distribution of air flow to the combustion process in such a manner that the formation of oxides of nitrogen are maintained at consistent levels while simultaneously maintaining carbon in fly ash and carbon monoxide at acceptable levels.

In recent years oxides of nitrogen, also known as $NO_x$, have been implicated as one of the elements in contributing to the generation of acid rain and smog. Now, due to very strict state and federal environmental regulations demanding that $NO_x$ emissions be maintained at acceptable levels, the control of the formation of $NO_x$ during the combustion process is of critical importance and a major concern in the design and operation of a power plant. As a consequence, combustion control systems must improve to meet these demands.

Oxides of nitrogen are a byproduct of the combustion of hydrocarbon fuels, such as pulverized coal in air, and are found in two main forms. If the nitrogen originates from the air in which the combustion process occurs, the $NO_x$ is referred to as 'thermal $NO_x$.' Thermal $NO_x$ forms when very stable molecular nitrogen, $N_2$, is subjected to temperatures above about 2800 F. causing it to break down into elemental nitrogen, N, which can then combine with elemental or molecular oxygen to form NO or $NO_2$. The rate of formation of thermal $NO_x$ downstream of the flame front is extremely sensitive to local flame temperature and somewhat less so to the local mole concentration of oxygen. Thermal $NO_x$ concentration can be reduced by lowering the mole concentrations of $N_2$ and $O_2$, reducing the peak flame temperature and reducing the amount of time that $N_2$ is subjected to these temperatures.

If the nitrogen originates as organically bound nitrogen within the fuel, the $NO_x$ is referred to as 'fuel $NO_x$.' The nitrogen content of coal is comparatively small and, although only a fraction is ultimately converted to $NO_x$, is the primary source of the total $NO_x$ emissions from a steam generating power plant. The formation rate of fuel $NO_x$ is strongly affected by the rate of mixing of the fuel and air stream in general, and by the local oxygen concentration in particular. The formation of fuel $NO_x$ is a multi-stage process. During initial coal particle heat up the coal is broken down into both volatile matter consisting of reactive cyanogens, oxycyanogens and amine species and char consisting of unburned carbon, hydrocarbons and ash. In an oxygen rich environment the volatile matter will convert largely to $NO_x$ and in a fuel rich environment it can be reduced to $N_2$. The remaining fuel bound nitrogen is released during char combustion. For char combustion to approach completion, an oxygen rich process is required. As with the volatile released $NO_x$, the eventual fate of char released nitrogen is dependent upon the specific time, temperature and stoichiometric history.

The stoichiometric ratio, $\phi$, of a combustion process is defined here as the number of moles of oxygen supplied to combust a given quantity of fuel divided by the number of moles of oxygen theoretically necessary to combust a the same quantity of fuel. Typically, the stoichiometric ratio in a fossil fuel fired steam generating power plant is a quantity greater than or equal to one and can be expressed as a percentage in which case it is referred to as percent theoretical air, $\tau=\phi\times100$. A related term is excess air which is $(\phi-1)\times100$ or $\tau-100$.

From the preceding it should be apparent that by controlling the distribution and mass flow rate of air to the combustion process the stoichiometric ratio of the process is controlled and thus the formation of $NO_x$. One method of controlling the mass flow rate of air to the combustion process within a tangentially fired furnace in order to effect a low $NO_x$ condition is through the use of staged combustion. Typically a main burner zone is defined wherein pulverized coal is combusted in a fuel rich environment. This is accomplished by withholding a portion of the total air required for complete combustion. This portion of air, which may appear in multiple segments and is commonly known as overfire air (OFA), is instead introduced above the main burner zone and mixed with the products of incomplete combustion after the $O_2$ content in the main burner zone is consumed. Staged combustion minimizes $NO_x$ formations via two mechanisms. First, by having a fuel rich atmosphere during the first stage, the initial amount of fuel $NO_x$ formed is reduced because less oxygen is available to combine with the fuel bound nitrogen. Second, lower fuel $NO_x$ results because of the reduced air concentrations during the initial firing stage, thus, primary stage residence time increases. Residence time is the amount of time necessary for a coal particle to combust. The increased residence time provides an environment which is conducive to the reduction of any oxidizable $N_2$ volatiles that have been formed such as $NH_3$ or HCN. This is done by entraining and reducing $NO_x$ compounds and the volatiles into their elemental components, oxygen and nitrogen, and combusting the hydrocarbons. Furthermore, staged combustion reduces the peak flame temperatures, resulting in lower thermal $NO_x$ formation.

In a typical configuration for a staged firing system utilizing OFA, combustion air is supplied by a forced draft fan to a common vertical plenum, known as the windbox, and then distributed to the furnace through a number of parallel ducts. Flow rates of combustion air are modulated by individual dampers. For control purposes the dampers are grouped into three categories: fuel/air dampers, adjacent to the fuel elevations, auxiliary air dampers, located between fuel elevations, and overfire air dampers, located above the fuel elevations. The OFA dampers can be further divided into two groups: close-coupled overfire air dampers which feed directly off of the top of the windbox and separated overfire air dampers which supply air to the upper levels of the furnace. Total flow of secondary air to the furnace is controlled by the forced draft fans. The auxiliary air dampers are used to control the windbox-to-furnace pressure differential, dp, as a function of total unit air flow. The fuel/air damper positions are set as a function of the coal feeder speed and the overfire air damper positions are set as a function of unit load or in some cases unit air flow.

Typical prior art combustion control systems consist of a means by which to measure total air flow to the furnace coupled with a means by which, in a preprogrammed manner, overfire air dampers are sequentially opened as unit air flow and unit load are increased; and in a reverse manner are sequentially closed as unit air flow and unit load decrease. This sequencing is based upon the designer's experience and must be field adjusted for a particular unit, at a given load, burning a given fuel. Thus, current combustion control technology makes no attempt to monitor or control main burner zone stoichiometry.

Achieving low $NO_x$ emissions comes at a cost, i.e. as $NO_x$ emissions diminish there is a concomitant increase in carbon monoxide and the presence of carbon in fly ash. The carbon monoxide and carbon in fly ash parallel one another as air is apportioned amongst the various overfire air levels. Theoretically, the ability to achieve low $NO_x$ emissions while simultaneously maintaining acceptable levels of carbon monoxide and carbon conversion efficiency depends heavily upon maintaining the proper main burner zone stoichiometric ratio. This has been substantiated by both field and laboratory testing. However, there are inherent difficulties in controlling main burner zone stoichiometry using the existing control methodology outlined above. The deficiencies include:

1. The main burner zone stoichiometry and the unit stoichiometry can not be adjusted independently. With the existing control method, if the flow of air through the forced draft fan is increased, so as to increase the excess air, the control action of the windbox-to-furnace pressure differential control loop will tend to redistribute a portion or all of the additional air to the main burner zone. Thus, the main burner zone stoichiometry will also increase as the excess air is increased. Corresponding decreases in main burner zone stoichiometry will result when excess air is decreased.
2. There is no means for directly setting a prescribed value of main burner zone stoichiometry. In fact, the nonlinear relationship between overfire air damper positions and main burner zone stoichiometry makes it difficult to even anticipate the amount of position adjustment required to produce a desired amount of change in stoichiometry. These factors increase the difficulty in field tuning the unit to obtain a desired system performance.
3. Changes in the windbox-to-furnace pressure differential setpoint schedule will change the main burner zone stoichiometry unless the overfire air damper positions are also adjusted. Thus, adjustments to the windbox-to-furnace pressure differential which may be made to vary firing conditions can become coupled to optimum overfire air damper settings, increasing the difficulty in field tuning the unit.

The new control method addresses these problems by providing a means for directly setting and maintaining main burner zone stoichiometry. By current methods, maintaining main burner zone stoichiometry is problematic in that fuel flow is not accurately measured, air flow to the main burner zone is typically not measured. Furthermore, fuel analysis, and therefore theoretical air requirements, is not accurately known. The conventional approach is to use trial and error to find a damper position versus boiler load curve that gives an "optimal" main burner zone stoichiometry. But this approach gives a main burner zone stoichiometry under fixed operating conditions, i.e.:

1. the same fuel is used
2. the fuel flow is constant for a given load
3. the same windbox to pressure differential exists
4. the same total air is present for a given load
5. the same boiler cleanliness exists The proposed method solves the problem of maintaining main burner zone stoichiometry by first calculating the unit stoichiometry from the measured % $O_2$ in the flue gas. From the unit stoichiometry it is determined how much overfire air is needed for a desired main burner zone stoichiometry. Finally, the air requirements for the main burner zone are determined by subtraction and thus the main burner zone stoichiometry can be calculated.

SUMMARY OF THE INVENTION

In accordance with one aspect of the present invention there is provided a control system operable for the purpose of maintaining a required stoichiometric ratio of a combustion process occurring within the main burner zone of a fuel fired furnace. The subject control system includes a stoichiometry subsystem, an overfire air subsystem and an override protection subsystem.

The stoichiometry subsystem is designed so as to be operable to calculate the mass flow rate of overfire air required to maintain the desired stoichiometric ratio within the main burner zone of a fuel fired furnace. The stoichiometry subsystem accepts as input, signals originating from sensors strategically located throughout the boiler complex that measure unit load, % $O_2$ and total unit air flow, as well as an override protection signal originating from the override protection subsystem. The stoichiometry subsystem operates on these input signals in a manner so as to provide as output a signal, representative of the required mass flow rate of overfire air, which in turn acts as one input to the overfire air subsystem.

The overfire air subsystem is designed so as to be operable to apportion the total overfire air, OFA, amongst close coupled overfire air, CCOFA, and separated overfire air, SOFA, levels. The overfire air subsystem accepts as input the signal originating from the stoichiometry subsystem which is representative of the required mass flow rate of overfire air as well as signals originating from sensors strategically located throughout the boiler complex that measure windbox-to-furnace pressure differential, windbox pressure, windbox temperature and total separated overfire air flow. The overfire air subsystem operates upon these signals in such a manner that a damper controller subsystem, incorporated within the overfire air subsystem, provides as output the required overfire air damper positions in such a manner that air is properly apportioned amongst the close coupled overfire air and separated overfire air levels and the main burner zone stoichiometric ratio is maintained.

The override protection subsystem is designed so as to be operable to ensure that the control of the windbox-to-furnace pressure differential maintains precedence over the stoichiometry subsystem in the event that these two control schemes have conflicting requirements. The override protection subsystem accepts as input a signal originating from a sensor located at the auxiliary air dampers that measures auxiliary air damper positions. The override protection subsystem operates upon this signal in a manner so as to provide as output an override protection signal which in turn acts as one input to the stoichiometry subsystem. The need for such additional logic can be understood by considering the effect of an excessive reduction in the main burner zone stoichiometry set point, $\phi_{mbz}$. As the demanded main burner zone stoichiometry is reduced, more air is diverted to the overfire air compartments and the auxiliary air dampers must close in order to maintain windbox-to-furnace pressure differential. Depending upon the total air flow into the furnace, if $\phi_{mbz}$ is set too low then, without additional control logic, the auxiliary air dampers would fully close and windbox-to-furnace pressure differential would no longer be controlled. To automatically prevent the above scenario, override protection logic is implemented which modifies $\phi_{mbz}$ as required to maintain a minimum opening for the auxiliary air dampers.

DESCRIPTION OF THE PREFERRED EMBODIMENT

Figure 1:
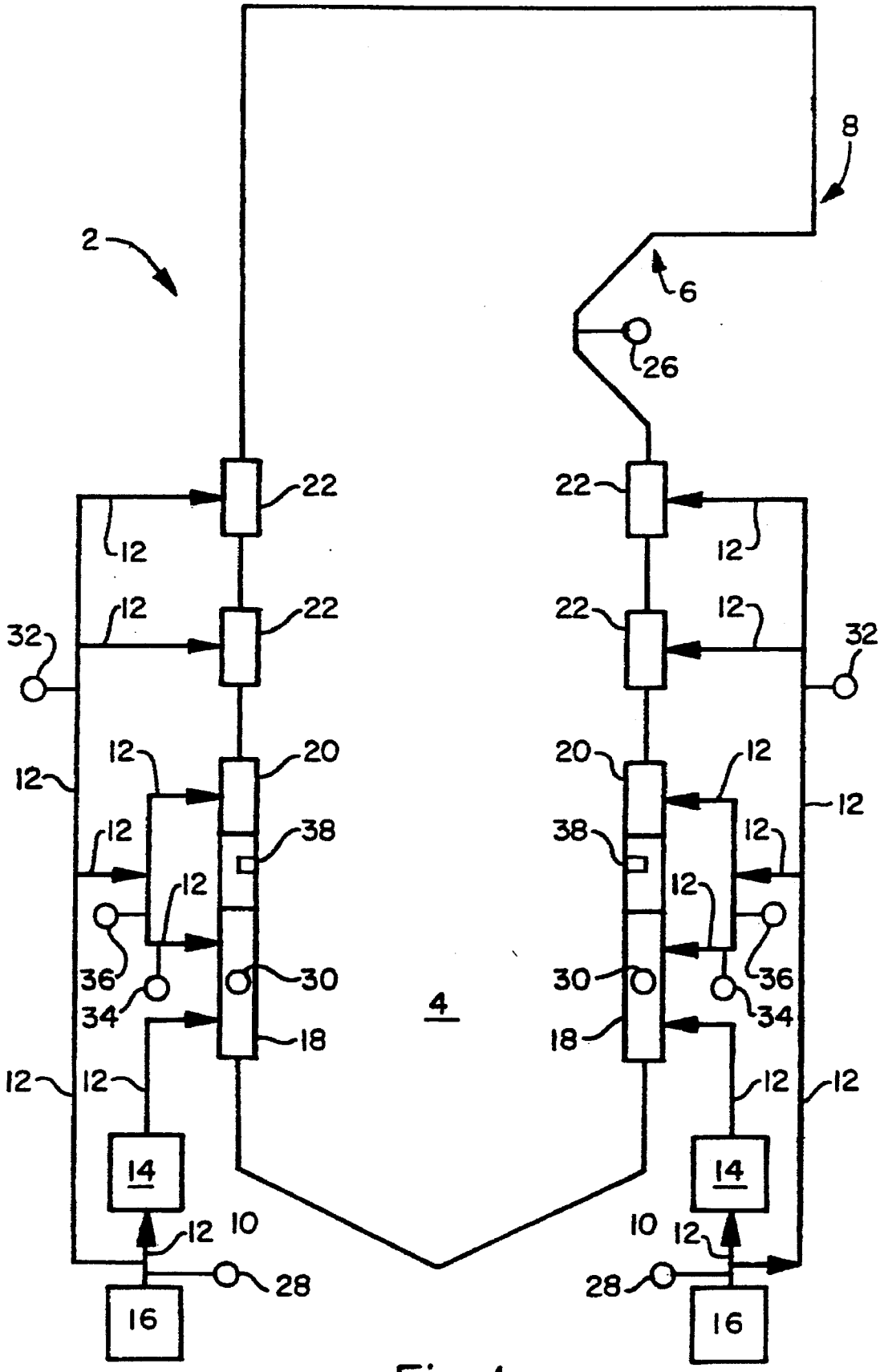
FIG. 1 is a diagrammatic representation in the nature of a vertical sectional view of a fuel-fired furnace embodying a tangential firing system in cooperation with a fuel and air supply means.

Referring now to FIG. 1 there is depicted a fuel fired furnace, generally designated by reference numeral 2. In as much as the nature of the construction and mode of operation of fuel fired furnaces are well known to those skilled in the art, it is deemed not necessary to set forth a detailed description of the fuel fired furnace 2. Rather, for purposes of obtaining an understanding of a fuel fired furnace it is deemed to be sufficient that there be presented herein merely a description of the nature of the components of the fuel fired furnace with which a tangential firing system cooperates. For a more detailed description of the nature of the construction and the mode of operation of the fuel fired furnace one may reference U.S. Pat. No. 4,719,587, which issued on Jan. 12, 1987 to F. J. Bette and which is assigned to the same assignee as the present patent application.

Referring further to FIG. 1 the fuel fired furnace 2 includes a main burner zone, generally designated by reference numeral 4. It is within the main burner zone 4 of the fuel fired furnace 2 that, in a manner well known to those skilled in the art, combustion of fuel and air is initiated. The hot gases that are produced from this combustion rise upwardly within the furnace and give up heat to the fluid passing through the furnace tubes (not shown for clarity of illustration) which in a conventional manner line all four walls of the furnace 2. Then the hot combustion gases exit the furnace 2 through the horizontal pass, generally designated by reference numeral 6 within the fuel fired furnace 2. This in turn leads to the rear gas pass of the furnace, generally designated by reference numeral 8. Both the horizontal pass 6 and the rear pass 8 commonly contain other heat exchange surfaces (not shown for clarity) for generating and super heating steam in a manner well known to those skilled in the art. Thereafter, the steam commonly is made to flow to a turbine (not shown), which forms one component of a turbine/generator set (not shown). The steam provides the motive power to drive the turbine which thence drives the generator, which in known fashion is cooperatively associated with the turbine such that electricity is produced from the generator.

Referring further to FIG. 1 there is also depicted a schematic representation of a means, generally designated by the numeral 10, for supplying fuel and air to the furnace 2. Said fuel and air supply means 10 consists of various ducts 12 so designed and constructed as to transport fuel and air, separately or if need be in combination, from a fuel source 14 and an air source 16 to a main windbox 18 which includes a set of close coupled overfire air (CCOFA) compartments 20, and a set of separated overfire air (SOFA) compartments 22, thence to the furnace 2 so as to support the aforesaid combustion. Also depicted in FIG. 1 are various sensors 26, 28, 30, 32, 34, 36, 38 mounted by conventional means and strategically located throughout the ductwork 12, furnace 2 and rear pass 8 so as to measure the % $O_2$ concentration in the exhaust gases, total unit air flow to the furnace, auxiliary air damper position, furnace pressure, windbox pressure and windbox temperature. Said sensors 26, 28, 30, 32, 34, 36, 38 are in communication by electrical signals with the main burner zone stoichiometry control system 100 shown in FIG. 2. For a more detailed description of the nature of construction and the mode of operation of the fuel and air supply means one may reference U.S. Pat. No. 5,315,939, which issued on May 31, 1994 to M. Rini et. al. and which is assigned to the same assignee as the present patent application.

Figure 2:
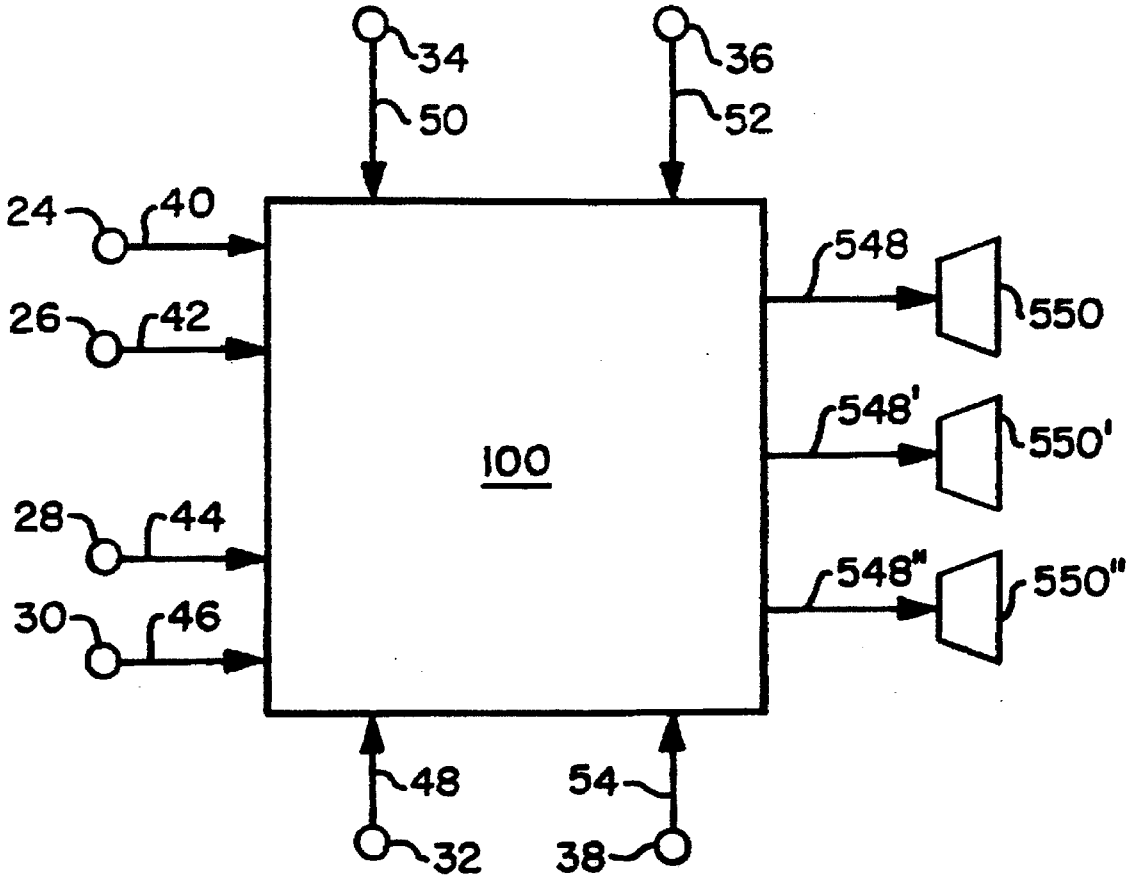
FIG. 2 is a generalized schematic representation in the nature of a main burner zone stoichiometric control system constructed in accordance with the present invention which is applicable for the use with the fuel-fired furnace depicted in FIG. 1.

Referring now to FIG. 2 there is depicted a generalized schematic diagram of the main burner zone stoichiometric control system 100 subject to stimulation by signals 40, 42, 44, 46, 48, 50, 52, 54 originating from the array of sensors 24, 26, 28, 30, 32, 34, 36, 38 strategically located throughout the boiler complex and in communication in accordance with conventional practice with the main burner zone stoichiometric control system 100. The main burner zone stoichiometry control system 100 is designed and constructed in accordance with the present invention so as to provide as output, due to said stimulation, a set of signals 548, 548', 548" which are representative of the required positions of the close coupled overfire air dampers 550 and separated overfire air dampers 550', 550" necessary to maintain the main burner zone stoichiometric ratio, $\phi_{mbz}$ and which position the dampers accordingly.

Figure 3:
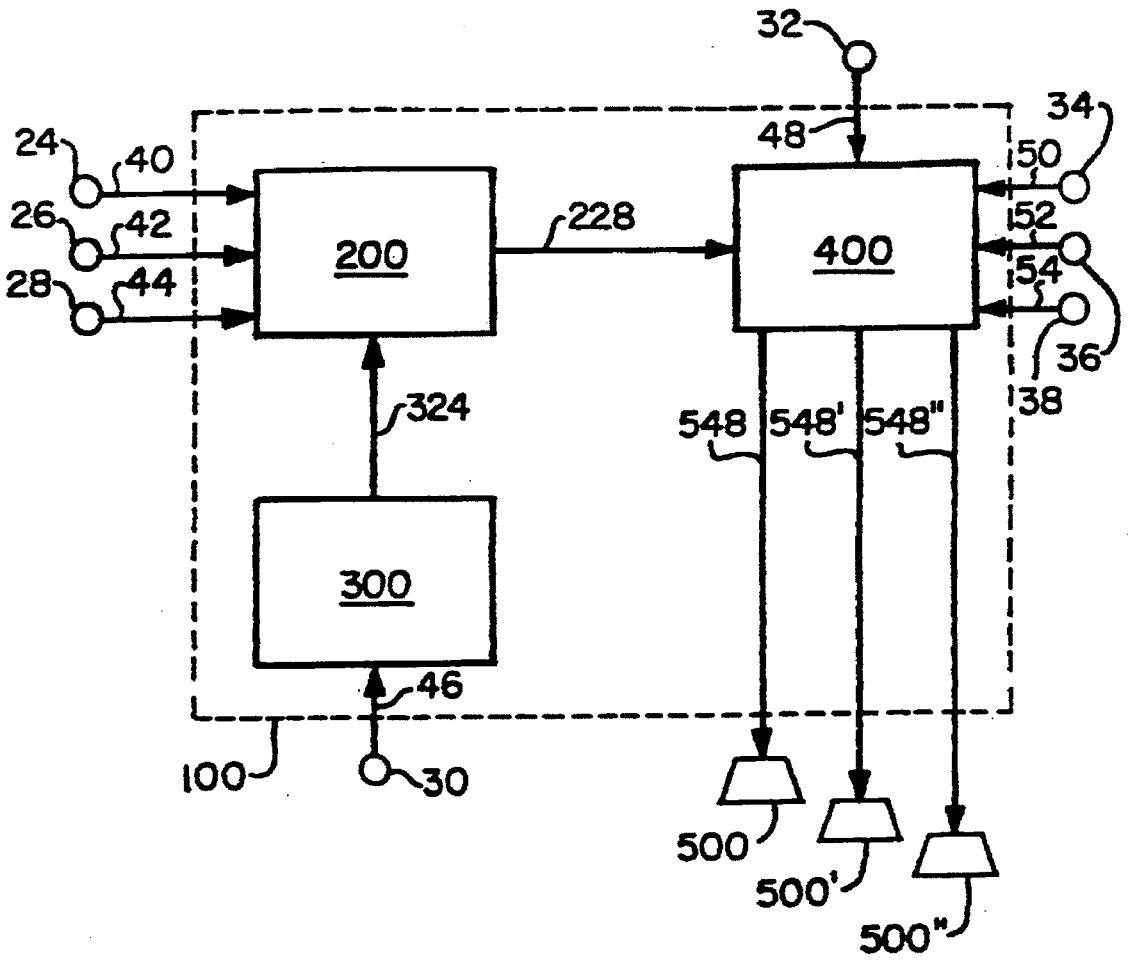
FIG. 3 is a schematic representation depicting the nature of the main burner zone stoichiometric control system of FIG. 2 as consisting of a stoichiometry subsystem, an overfire air subsystem and an override protection subsystem, and constructed in accordance with the present invention.

Referring now to FIG. 3 there is depicted the main burner zone stoichiometric control system 100 as it is comprised of the stoichiometry subsystem 200, the override protection subsystem 300, and the over fire air subsystem 400 and their interconnecting signal paths. It is seen in FIG. 3 that the override protection subsystem 300 is subject to stimulation by a signal 46 originating from the auxiliary air damper position sensor 30 and representative of the auxiliary air damper position. Furthermore, the override protection subsystem 300 which is in communication in accordance with conventional practice with the stoichiometry subsystem 200 provides as output, resulting from said stimulation, an override protection signal 324 which acts as one input to the stoichiometry subsystem 200. It is further seen in FIG. 3 that the stoichiometry subsystem 200 is subject to stimulation by signals 40, 42, 44, 324 originating from the unit load sensor 24, % $O_2$ sensor 26, total air flow sensor 28 and the override protection subsystem 300. These signals are respectively representative of unit load on the boiler, % $O_2$ concentration in the exhaust gases, total unit air flow into the furnace, and the override protection signal. The stoichiometry subsystem 200, which is in communication in accordance with conventional practice with the overfire air subsystem 400, then provides as output, due to said stimulation, a signal 228 which acts as one input to the overfire air subsystem 400 and is representative of the mass flow rate of overfire air required to maintain the main burner zone stoichiometric ratio, $\phi_{mbz}$.

It is also seen in FIG. 3 that the overfire air damper subsystem 400 is subject to stimulation by signals 48, 50, 52, 54 originating from the separated overfire air flow sensor 32, the windbox pressure sensor 34, the windbox temperature sensor 36 and the furnace pressure sensor 38, respectively. These signals are respectively representative of the total mass flow rate of separated overfire air, windbox pressure, windbox temperature and furnace pressure. The overfire air subsystem 400 then provides as output, due to said stimulation, a set signals 548, 548', 548" which are representative of the close coupled and separated overfire air damper positions required to maintain the main burner zone stoichiometric ratio and which position those dampers accordingly.

Figure 4:
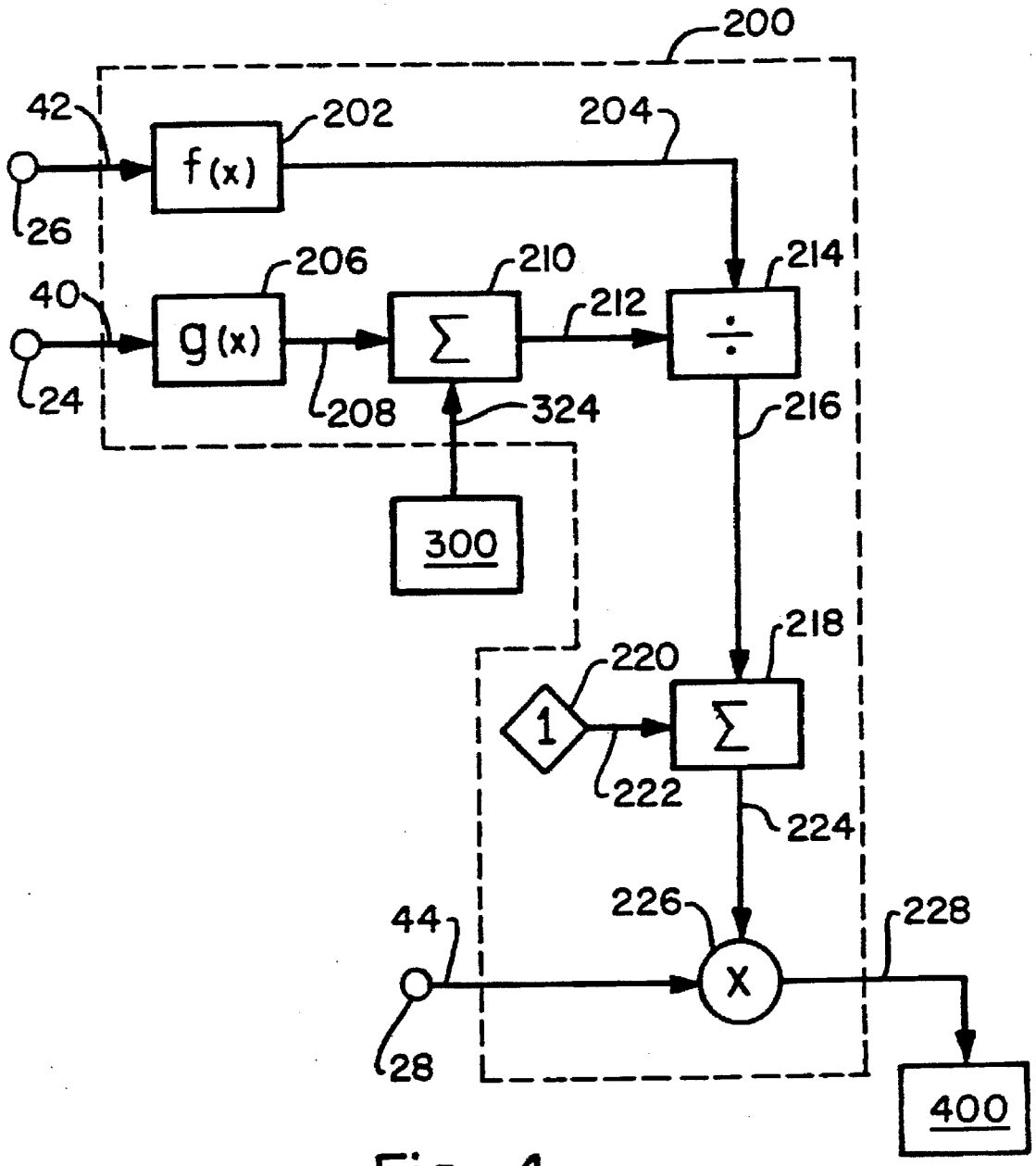
FIG. 4 is a schematic representation of the stoichiometry subsystem of FIG. 3 constructed in accordance with the present invention.

To further elaborate, reference is now made to FIG. 4 depicting a more detailed schematic diagram of the stoichiometry subsystem 200 showing the arrangement of the functional equivalents of its component parts and their interconnecting signal paths. Said signal paths are made operable in accordance with conventional practice. More specifically, the stoichiometry subsystem 200 is comprised of a first signal adder 210, a second signal adder 218, a signal multiplier 226 and a signal divider 214, all of which are operable in accordance with conventional practice. Furthermore, said stoichiometry subsystem 200 includes a first signal generator 202, a second signal generator 206 and a third signal generator 220 each of which is operable in accordance with conventional practice.

Figure 12:
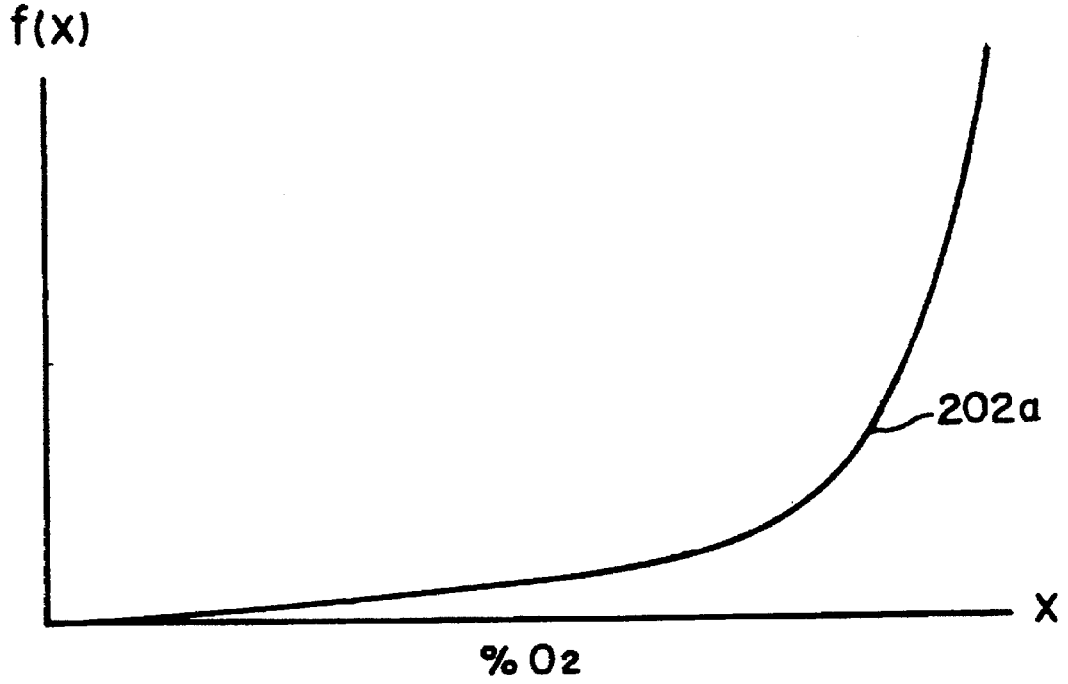
FIG. 12 is a graphical depiction of unit stoichiometric ratio as a function of measured % $O_2$ in the flue gas leaving the furnace.
Figure 13:
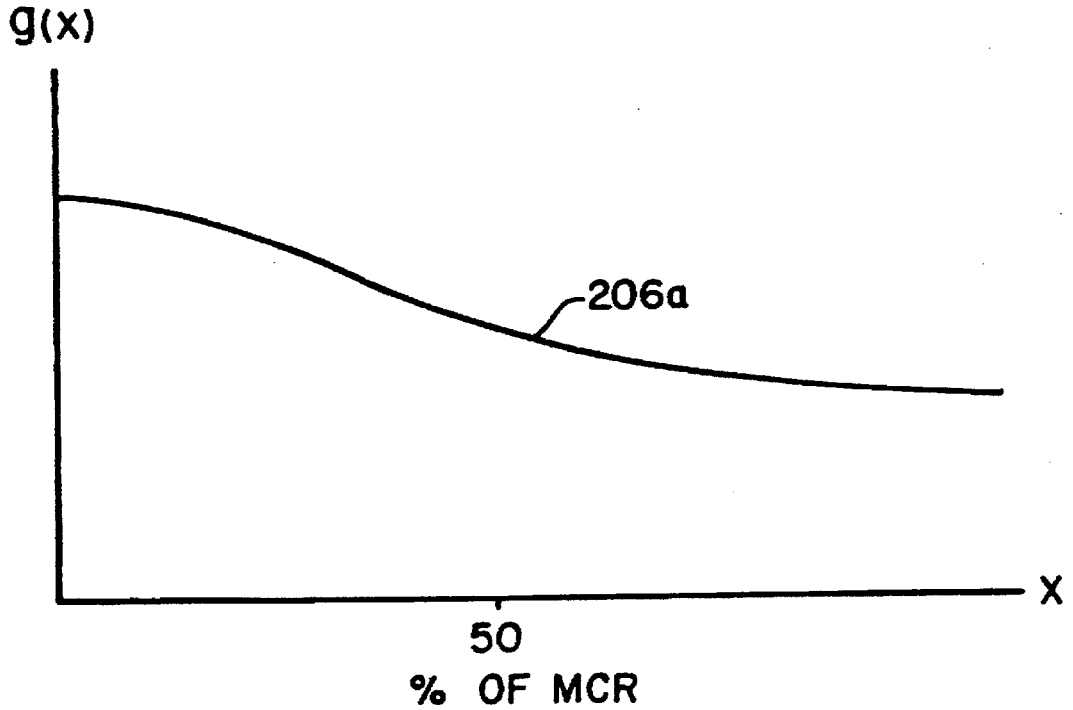
FIG. 13 is a graphical depiction of a representative main burner zone stoichiometric ratio as a function of unit air flow.

The second signal generator 206, whose input/output relationship is as generically shown by curve **206*a* in FIG. 13, is subject to stimulation by a signal 40 originating from the unit load sensor 24 and representative of the percentage of the Maximum Continuous Rating (MCR) at which the boiler operates. The second signal generator 206 then provides as output, due to all of said stimulation, a signal 208 representative of the main burner zone stoichiometric ratio set point, which may also be established by a closed loop supervisory control system to optimize performance based upon measurements of NOX emissions and unburned combustibles or other boiler performance variables. Said signal 208 is then added, by way of the first signal adder 210, to the override protection signal 324 originating from the override protection subsystem 300 to yield a signal 212 representative of the modified main burner zone stoichiometric ratio set point. Continuing, the first signal generator 202, whose input/output relationship is as generically shown by curve 202*a* in FIG. 12, is subject to stimulation by a signal 42 originating from the % $O_2$ sensor 26 and representative of % $O_2$ in the flue gases. Said first signal generator 202 then provides as output, due to said stimulation, a signal 204, representative of the unit stoichiometric ratio. Continuing further in FIG. 4, the modified main burner zone stoichiometric ratio set point signal 212 is divided by the unit stoichiometric ratio signal 204 by way of the signal divider 214 to yield as output a signal 216 representative of the fraction of total unit air allocated to the main burner zone 4. Said output signal 216 is then subtracted, by way of the second signal adder 218, from a constant signal 222 which is equal to unity and originates from the third signal generator 220 to yield a signal 224 representative of the fraction of total unit air allocated to overfire air. Continuing still further, said signal 224 is multiplied, via the signal multiplier 226, by a signal 44 originating from the air flow sensor 28 and representative of the total unit air flow to the furnace to yield a signal 228** representative of the mass flow rate of overfire air required to maintain main burner zone stoichiometric ratio, $\phi_{mbz}$.

Figure 5:
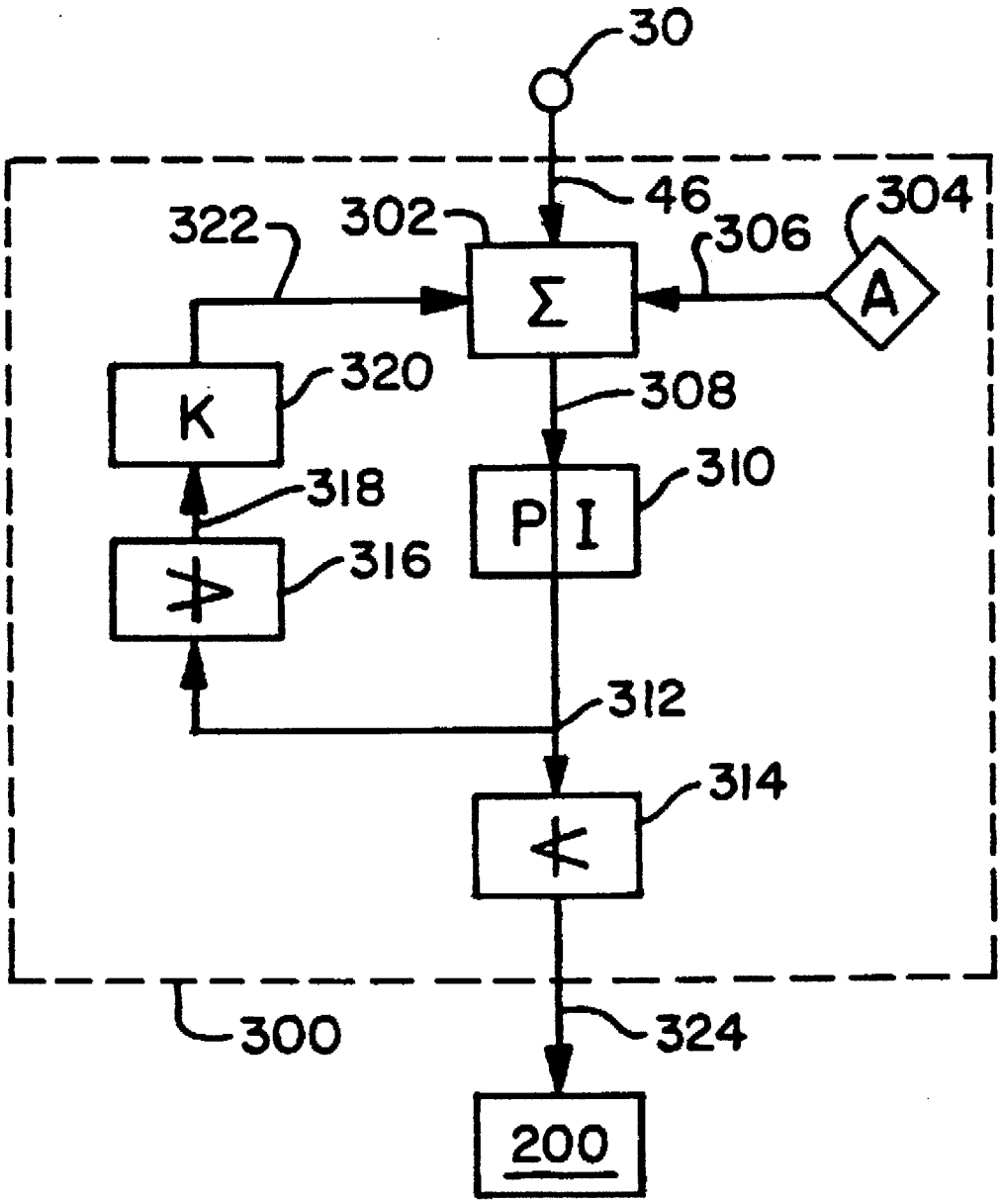
FIG. 5 is a schematic representation of the override protection subsystem of FIG. 3 constructed in accordance with the present invention.

Referring now to FIG. 5 there is depicted a more detailed schematic diagram of the override protection subsystem 300 showing the arrangement of the functional equivalents of its component parts and their interconnecting signal paths. Said signal paths are made operable in accordance with conventional practice. More specifically the override protection subsystem 300 is comprised of a signal adder 302, a proportional-plus-integral (PI) controller 310, a signal generator 304, a low limiter 314, a high limiter 316 and a gain multiplier 320, all of which are operable made by conventional practice. The override protection subsystem 300 is subject to stimulation by a signal 46 originating from the auxiliary air damper sensor 30 and representative of the auxiliary damper position. Said signal 46 is added, by way of the signal adder 302, to a modified feedback signal 322, later described, and to a constant signal 306 originating from the signal generator 304 and representative of a preset minimum allowable value, 'A', for the auxiliary air damper position. Said addition yields an error signal 308 which is integrated, in a manner known and understood by those skilled in the art, by the PI controller 310 generating an override protection signal 312. The override protection signal 312 acts first as input to a low limiter 314 and secondly as a feedback signal passed through a high limiter 316 and a gain multiplier 320. The output of the gain multiplier 320 and high limiter 316 is a modified feedback signal 322 which is added to the auxiliary air damper position signal 46 and the minimum allowable auxiliary air damper position signal 306 via the signal adder 302.

As the main burner zone stoichiometric ratio set point decreases the auxiliary air dampers begin to close and the overfire air dampers 548, 548', 548" begin to open. However, the windbox-to-furnace pressure differential must be maintained as this happens. If the auxiliary air dampers close too far such that the auxiliary air damper position signal 46 falls below the minimum allowable value, 'A', the error signal 308 becomes positive and a positive override protection signal 324 is generated which acts as one input to the stoichiometry subsystem 200. Said input signal 324 acts to increase the main burner zone stoichiometric ratio set point causing the overfire air dampers to close. Now, the windbox-to-furnace pressure differential increases, causing the auxiliary air dampers to open and the auxiliary air damper position signal 46 to return to the minimum allowable value. As long as the windbox-to-furnace pressure differential is maintained no override protection signal 324 is generated. To satisfy this requirement, the low limiter 314 ensures that the override protection signal 312 is never less than zero.

The modified feedback signal 322 prevents 'wind-up' in the PI controller 310 when the auxiliary air dampers are sufficiently open. By making the feedback gain, 'K', sufficiently large, 'wind-up' is minimized. The override protection subsystem 300 may also be implemented by the use of binary logic, binary logic being known and understood by those skilled in the art.

Figure 6:
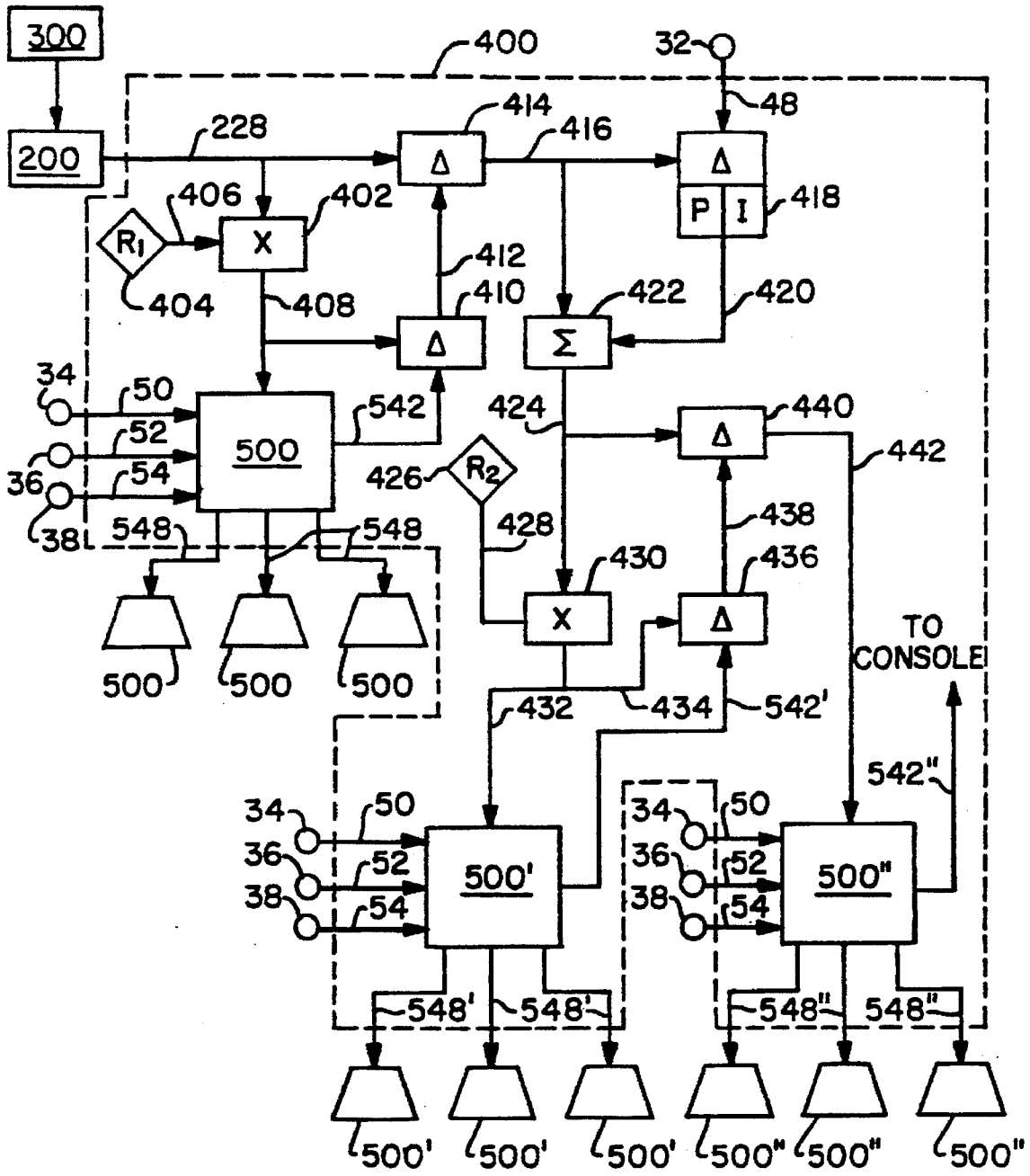
FIG. 6 is a schematic representation of the overfire air subsystem of FIG. 3 constructed in accordance with the present invention.

Referring now to FIG. 6 there is depicted a more detailed schematic diagram of the overfire air subsystem 400 showing the arrangement of the functional equivalents of its component parts and their interconnecting signal paths. Said signal paths are made operable in accordance with conventional practice. More specifically the overfire air subsystem 400 is comprised of two signal multipliers 402 430, a signal adder 422, four signal differencers 410, 414, 436, 440 three damper controllers 500, 500', 500", and two signal generators 404, 426, all of which are made operable by conventional practice. The overfire air subsystem 400 is subject to stimulation by a signal 228 originating from the stoichiometry subsystem 200 and representative of the mass flow rate of overfire air required to maintain the main burner zone stoichiometric ratio. The overfire air subsystem 400 is also subject to stimulation by a signal 48 originating from the separated overfire air flow sensor 32 and representative of the total mass flow rate of air carried by the SOFA dampers. The overfire air subsystem 400 is subject to still further stimulation by a plurality of signals 50, 52, 54, originating from the windbox pressure sensor the windbox temperature sensor 36 and the furnace pressure sensor 38 and are respectively representative of the windbox pressure, windbox temperature and furnace pressure. The overfire air subsystem 400 provides as output, due to all of said stimulation, a plurality of signals 548, 548', 548" which are respectively representative of the close coupled, low separated and high separated overfire air damper positions required to maintain the main burner zone stoichiometric ratio and which position those dampers accordingly. The purpose of the overfire air subsystem 400 is to apportion air amongst the close coupled overfire air dampers 550 and the low separated and high separated overfire air dampers 550', 550". To that end, that signal 228 representative of the mass flow rate of air required to maintain the main burner zone stoichiometric ratio, $\phi_{mbz}$, is multiplied, via the first signal multiplier 402, by that signal 406, originating from the first signal generator 404 and representative of the desired ratio, R1, of the mass flow rate of close coupled overfire air (CCOFA) to the mass flow rate of total overfire air (OFA). Said signal 406 can be established by a closed loop supervisory control system to optimize performance based upon measurements of $NO_x$ emissions and unburned combustibles or other boiler performance variables. Continuing, said signal multiplier 402 provides as output a signal 408 representative of the mass flow rate of CCOFA and which acts as one input to the CCOFA damper controller 500, later described.

Said CCOFA damper controller 500 provides as one output a capacity error signal 542, representative of the amount by which the CCOFA mass flow rate exceeds the CCOFA damper capacity. If the amount of the CCOFA mass flow rate exceeds the fully open capacity of the CCOFA dampers 550 then the CCOFA mass flow rate will be clipped, within the damper controller 500, at the maximum capacity of the CCOFA dampers. Said capacity error signal 542 is subtracted, via the first signal differencer 410, from that signal 408 representative of mass flow rate of CCOFA to yield a signal 412 representative of the commanded mass flow rate of CCOFA. If the capacity of the CCOFA dampers is not exceeded then the capacity error signal 542 is zero. The commanded mass flow rate signal 412 is subtracted, via the second signal differencer 414, from that signal 228 representative of the mass flow rate of OFA required to maintain the main burner zone stoichiometric ratio, $\phi_{mbz}$, yielding a signal 416 representative of the mass flow rate of air allocated to separated overfire air. Continuing with the overfire air subsystem 400, the PI controller 418 is first subject to stimulation by a signal 48 which originates from the separated overfire air (SOFA) air flow sensor 32 and is representative of the total flow rate of air carried by the low SOFA and high SOFA dampers 550', 550" and secondly by that signal 416 which is representative of the mass flow rate of air allocated to the low SOFA and high SOFA dampers 550', 550". Specifically the PI controller 418 acts upon the difference between the signal 416 representative of the mass flow rate of air allocated to SOFA and the signal 48 which is representative of the total flow rate of air carried by the low SOFA and high SOFA dampers 550', 550" to provide as output a corrective feedback signal 420. Said corrective feedback signal 420 is then added, via the signal adder 422, to that signal 416 representative of the mass flow rate of air allocated to the low SOFA and high SOFA dampers 550', 550" to yield a further signal 424 that compensates for any inaccuracies in damper characterization.

Continuing with the overfire air subsystem 400, determining the allocation of the mass flow rate of overfire air between the low SOFA and high SOFA dampers 550', 550" is accomplished in a fashion identical to that utilized in determining the allocation of the total mass flow rate of overfire air between the CCOFA dampers 550 and the low SOFA and high SOFA dampers 550', 550" Specifically that signal 442 representative of the mass flow rate of air distributed to the high SOFA 550" dampers is determined in a manner functionally identical to that used in determining that signal 416 representative of the mass flow rate of air allocated to both sets of SOFA dampers 550', 550". In keeping with this fact it is noted that that signal 428 originating from the second signal generator 426 and representative of the desired ratio, R2, of the mass flow rates of air between the two SOFA levels may also be established by a closed loop supervisory control system to optimize performance based upon measurements of NOX emissions and unburned combustibles or other boiler performance variables.

Figure 7:
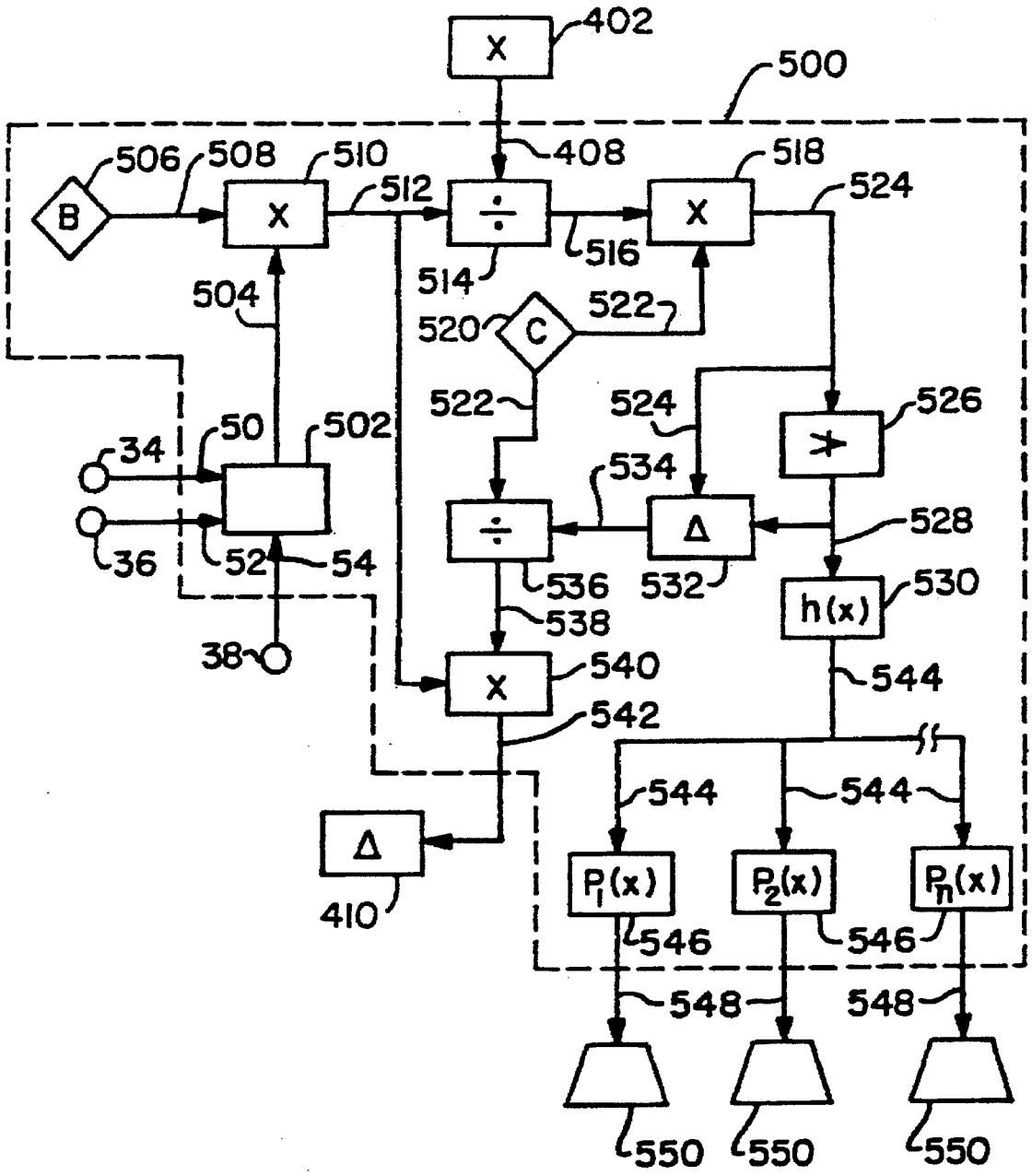
FIG. 7 is a schematic representation of the damper controller subsystem of FIG. 6 constructed in accordance with the present invention.

Referring now to FIG. 7 there is depicted a more detailed schematic diagram representative of the damper controllers 500, 500', 500" shown in FIG. 6. Said damper controllers 500, 500', 500" are identical in function. Thus, for purposes of simplification, FIG. 7 depicts the arrangement of the functional equivalents of the component parts and interconnecting signal paths of the CCOFA damper controller 500 only and its description will similarly serve as a description for the low SOFA and high SOFA damper controllers 500', 500". Said signal paths of the damper controllers are made operable in accordance with conventional practice. More specifically, the damper controller 500 is comprised of a signal converter 502, three signal multipliers 510, 518, 540, two signal dividers 514, 536, a high limiter 526, a signal differencer 532, a first signal generator 506, a second signal generator 520, a third signal generator 530 and a plurality of signal generators each of which is designated by the reference numeral 546. All of the said functional equivalents are operable in accordance with conventional practice.

The damper controller 500 is subject to stimulation by a signal 408 originating from the signal multiplier 402 within the overfire air subsystem 400 and representative of the mass flow rate of air allocated to the CCOFA level. The CCOFA damper controller 500 is further stimulated by a signal 54 originating from the furnace pressure sensor 38 and representative of the furnace pressure, a signal 50 originating from the windbox pressure sensor 34 and representative of the absolute windbox pressure and a signal 52 originating from the windbox temperature sensor 36 and representative of the windbox temperature. Said CCOFA damper controller 500 provides as output, due to said stimulation, a capacity error signal 542, described above, and signals 548 representative of the CCOFA damper position which activates said dampers 550 accordingly.

Continuing, a signal 504 representative of a correction factor and based upon measurements of furnace pressure, absolute windbox pressure and windbox temperature is computed via said signal converter 502 in a manner that would be understood by those skilled in the art. The signal 504 is multiplied, via the first signal multiplier 510, by a signal 508 originating from the first signal generator 506 and representative of a reference mass flow rate of air to yield as output a signal 512 representative of the maximum mass flow rate capacity of the CCOFA dampers 550. Said signal 512 acts in turn first as input to the first signal divider 514 and secondly as input to the second signal multiplier 540, later described. Furthermore, that signal 408 originating from the first signal multiplier 402 shown in FIG. 6 and representative of the mass flow rate of air allocated to the CCOFA dampers is divided, via the first signal divider 514, by that signal 512 representative of the maximum mass flow rate capacity of the CCOFA dampers 550 to yield as output a signal 516 representative of the flow of air to CCOFA ratioed to the maximum flow capacity of the CCOFA dampers under the given conditions of windbox-to-furnace pressure differential, absolute windbox pressure and windbox temperature. Said signal 516 is multiplied, via the third signal multiplier 518, by a constant signal 522 originating from the second signal generator 520 and representative of a multiplicative factor of 100 to yield as output a signal 524 representative of the percentage of the maximum flow capacity of the CCOFA dampers 550. Said signal 524 acts as input first to the high limiter 526 and secondly to the signal differencer 532. The high limiter 526 clips this input signal 524 such that the high limiter provides as output a signal 528 which is representative of the percentage of the maximum flow capacity of the CCOFA dampers and will not exceed 100% of that quantity. The high limiter output signal 528 in turn acts as input first to the signal differencer 532 along with the high limiter input signal 524 and secondly to the third signal generator 530, later described. The signal differencer 532 takes the difference between the two input signals 524, 528 and provides as output a signal 534 representative of the percent by which air flow to the CCOFA dampers 550 exceeds their capacity. The output signal 534 of the signal differencer 532 further acts as a first input to the second signal divider 536 which also accepts, as a second input, a constant signal 522 originating from the second signal generator 520 and representative of a multiplicative factor of 100. Said second signal divider 536 divides the first input signal 534 by the second input signal 522 to yield as output a signal 538 which is representative of the fraction by which air flow to the CCOFA dampers is in excess of their capacity. This output signal 538 is in turn multiplied, via the second signal multiplier 540, by that signal 512 which acts as the output signal of the first signal multiplier 510 and is representative of the maximum mass flow rate capacity of the CCOFA dampers to yield, as output, the aforementioned capacity error signal 542.

Figure 14:
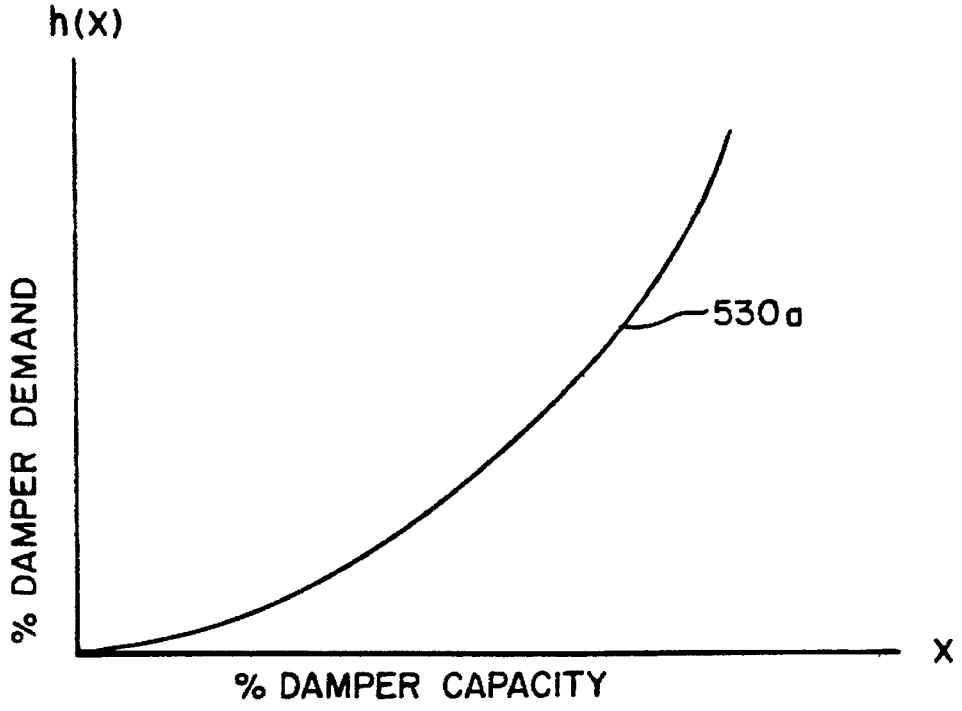
FIG. 14 is a graphical representation of percent damper demand as a function of percent damper capacity.
Figure 15:
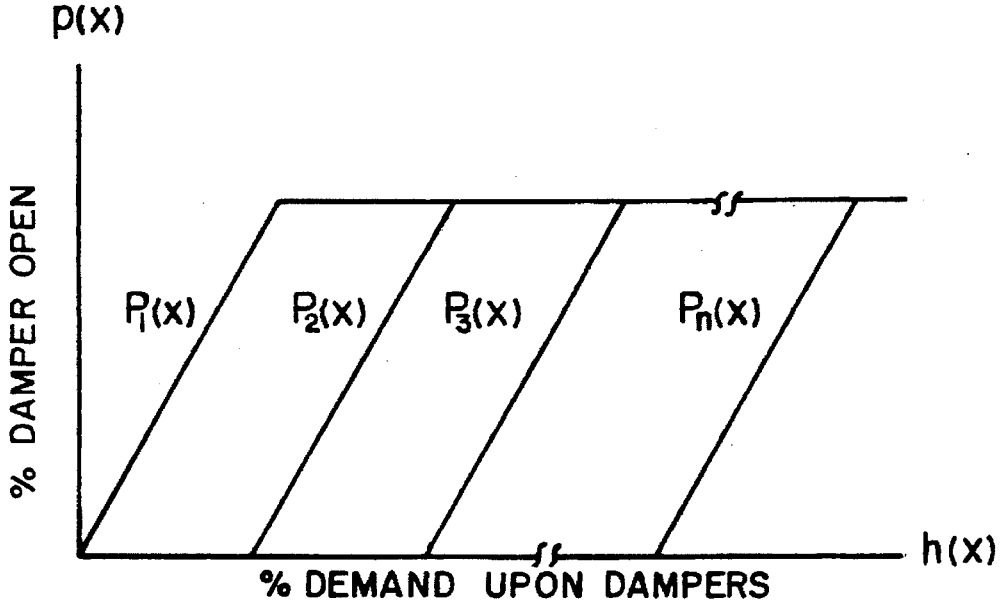
FIG. 15 is a graphical representation of damper sequencing as a function of percent damper demand.

Returning now to the output signal 544 of the high limiter, that signal acts as input to the third signal generator 530 which characterizes the CCOFA damper demand as a function of the percentage of the maximum flow capacity of the CCOFA dampers. The input/output relationship of the third signal generator 530 is as generically shown by curve 530*a* in FIG. 14. The third signal generator 530 provides as output a signal 544 which is representative of the percent demand placed upon the CCOFA dampers 550 and which acts as input to the plurality of signal generators S46. The signal generators S46 act as a sequencing mechanism. As the demand, h(x), placed upon the CCOFA dampers 550 increases the dampers are sequentially opened in a predetermined fashion as is generically shown by curves $pl_x$ through $pn_x$ in FIG. 15. The signal generators 546 each provide as output a signal S48 representative of the respective positions of the corresponding CCOFA dampers 550 required to the maintain main burner zone ratio, $\phi_{mbz}$, and which act so as to position the dampers accordingly. The number, n, of dampers utilized is variable and based upon the specific design of the firing system.

Figure 8:
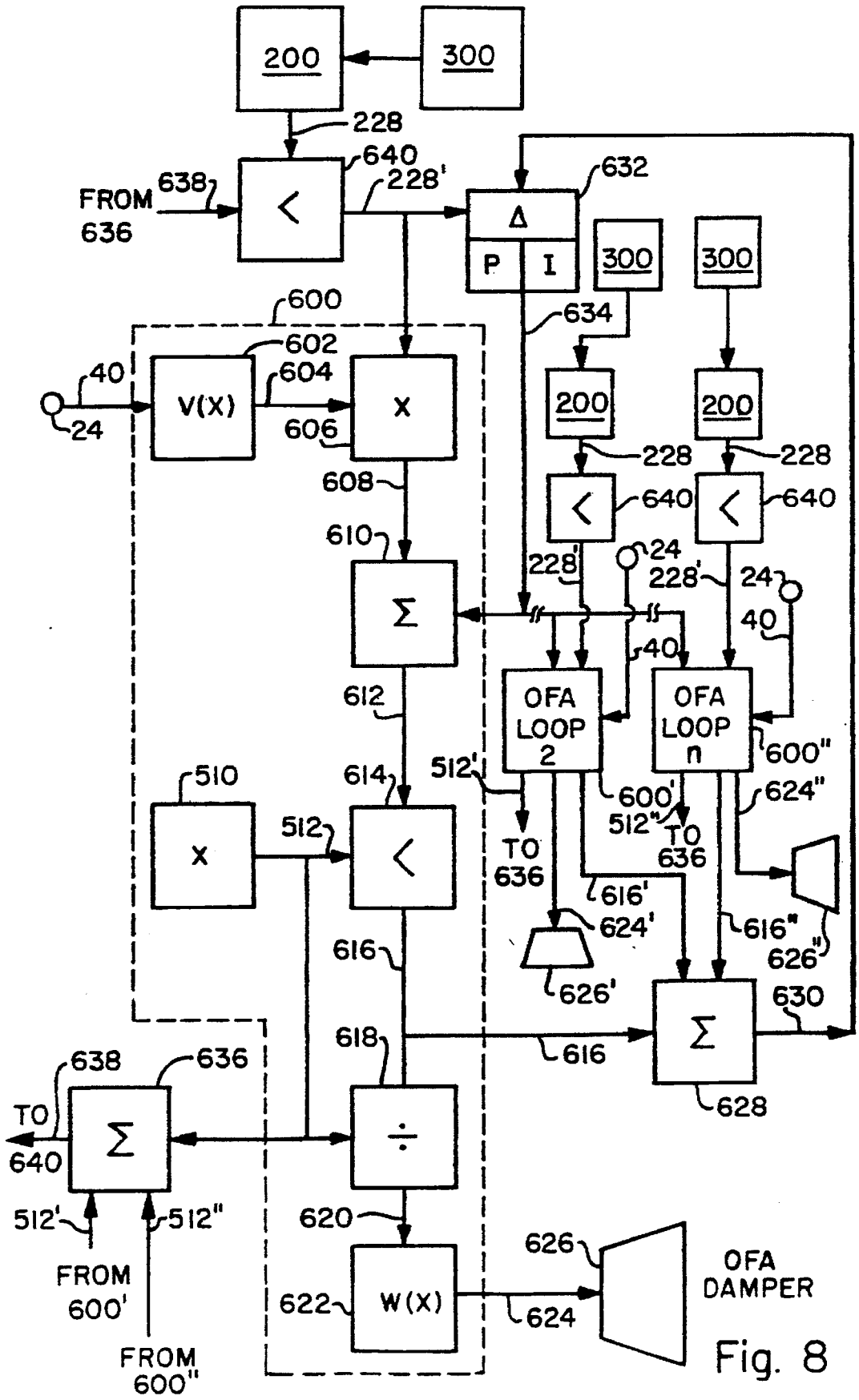
FIG. 8 is a schematic representation of an alternative configuration of the overfire air subsystem constructed in accordance with the present invention.

Referring now to FIG. 8 there is depicted a detailed schematic diagram of an alternative configuration 600 for the overfire air subsystem 400 shown in FIG. 6. FIG. 8 shows the arrangement of the functional equivalents of this configuration's component parts and their interconnecting signal paths. Said signal paths are made operative in accordance with conventional practice. More specifically the air alternative configuration 600 of the overfire subsystem 400 is comprised of a first signal generator 602, a second signal generator 622, a signal multiplier 606, a signal adder 610, a low signal selector 614, and a signal divider 618. The alternative configuration 600 is subject to stimulation by a signal 40 originating from the unit load sensor 24 and representative of the load upon the boiler expressed as a fraction of the Maximum Continuous Rating at which the boiler operates. The alternate configuration 600 is also subject to stimulation by a conventional signal 228' originating from a second low signal selector 640, later described. Said input signal 228' is representative of the mass flow rate of overfire air required to maintain the main burner zone stoichiometric ratio, $\phi_{mbz}$. The alternate configuration 600 is subject to still further stimulation by a signal 634 originating from the proportional-plus-integral controller 632, later described, and representative of a capacity error in the plurality of overfire air dampers 626, 626', 626". The alternate configuration 600 of the overfire air subsystem 400 is designed and constructed in accordance with the present invention to provide as output, due to all of said stimulation, a signal 624 representative of the overfire air damper position which also acts to position the overfire air damper 626 accordingly. Said output signal 624 may also act as input to the signal generator 546 of FIG. 7. The alternate configuration 600 of the overfire air subsystem 400 also provides as output, due to all of said stimulation, a signal 616 which is representative of the portion of total overfire air carried by the overfire air damper 626. Furthermore, said alternate configuration 600 provides as output, a signal 512 originating from the signal multiplier 510 described above, in context with the damper controller 500, and representative of the maximum mass flow rate capacity of the overfire air damper 626. In this configuration the total quantity of overfire air available is controlled such that a specified fraction of the total overfire air is allocated to each damper as a function of unit load. The alternate configuration 600 is coupled with possibly numerous like configurations which are depicted by reference numerals 600' and 600" in FIG. 8 such that any demand placed upon a damper in excess of its capacity is evenly divided amongst other available dampers. The number, n, of dampers required is variable and based upon the specific design of the firing system. More specifically said first signal generator 602 is subject to stimulation by a signal 40 originating from the unit load sensor 24 and representative of the load placed upon the boiler expressed as a fraction of the maximum continuous rating of the boiler. The input/output relationship of the first signal generator 602 relates the fraction of overfire air to the unit load. It is a functional relationship that is unit specific and experimentally determined and may be adjusted to meet the needs of the boiler operator. The first signal generator 602 thus provides as output a signal 604 representative of the fraction of overfire air allocated to the overfire air damper 626. Said output signal 604 is then multiplied, via the first signal multiplier 606, by that signal 228', described above, originating from the stoichiometry subsystem 200, to yield an output signal 608 representative of that portion of the total mass flow rate of overfire air allocated to the overfire air damper 626. Said output signal 608 is then added, via the first signal adder 610, to a capacity error signal 634 originating from the PI controller 632, later described, to yield as output a signal 612 representative of the total mass flow demand placed upon the overfire air damper 626. The total mass flow rate demand signal 612 is compared, via the low signal selector 614, with the maximum mass flow rate damper capacity signal 512, described above, and the lesser quantity provided as output. Said output signal 616 is therefore representative of the demand of that fraction of the total mass flow rate of overfire air placed upon the overfire air damper 626, though not exceeding the maximum mass flow rate capacity of the damper 626. Said signal 616 is then divided, via the first signal divider 618, by the maximum mass flow rate damper capacity signal 512 to yield as output a signal 620 representative of the demand placed upon the overfire air damper expressed as a fraction of the maximum capacity of the overfire air damper 626. Said signal 620 then acts as input to the second signal generator 622 which characterizes the percent by which the overfire air damper is open as a function of the demand placed upon the damper expressed as a fraction of the mass flow rate damper capacity. The second signal generator 622 thus provides as output a signal 624 which is representative of the percent by which the overfire air damper 626 is open and which also acts so as to position the damper 626 accordingly.

As stated above the alternate configuration 600 of the overfire air subsystem 400 provides as output a signal 616 representative of the portion of total overfire air carried by the overfire air damper and is also subject to stimulation by signal 634 originating from the PI controller 632 and representative of the damper capacity error. It was also stated above that this configuration 600 is coupled with possibly numerous like control loops 600', 600" Explanation will now be made as to the functional interrelation of said signals and control loops. A second signal adder 628 accepts as input that signal 616 originating from the alternate configuration 600 and which is representative of the demand of that portion of the total mass flow rate of overfire air placed upon the overfire air damper 626. Said signal adder 628 also accepts like signals 616', 616" which originate from like control loops 600', 600" but are now representative of the demand of that portion of the total mass flow rate of overfire air placed upon their respective dampers 626', 626". Thus the second signal adder 628 provides as output a signal 630 representative of the total mass flow rate demand placed upon all dampers and which then acts as one input to the PI controller 632. Said PI controller 632 also accepts as input that signal 228' which originates from the second low signal selector 640 and is representative of the mass flow rate of overfire air required to maintain the main burner zone stoichiometric ratio, $\phi_{mbz}$. The PI controller 632 acts upon said input signals 228' 630 in a manner which would be understood by those skilled in the art so as to provide as output a capacity error signal 634. Said output signal 634 is of such a character that when the total mass flow rate demand signal 630 is less than the required mass flow rate signal 228' the capacity error signal 634 seeks to increase the demand signal 612 to each damper via the first signal adder 610 until the total mass flow rate demand equals the required mass flow rate. If the required fraction of overfire air allocated to all of the overfire air dampers 626, 626', 626" is within their capacity limit, then the total mass flow rate demand will equal the required mass flow rate and no corrective action occurs. Whenever the required mass flow rate is less than the total mass flow rate demand the capacity error signal 634 seeks to decrease the demand signal 612 via the first signal adder 610, again until the total mass flow rate demand equals the required mass flow rate. It is further seen in FIG. 8 that the capacity error signal 634 acts as one input to any like control loops 600', 600" as well. The result is to achieve the desired apportionment of overfire air amongst the various dampers by distributing any flow which exceeds the capacity of an individual damper equally amongst the other available dampers.

It is also seen in FIG. 8 that the alternate configuration 600 of the overfire air subsystem 400 provides as output a signal 512 originating from the second signal multiplier 510, described above, and representative of the maximum mass flow rate capacity of the overfire air damper 626. Similar signals also act as output from any like overfire air control loops 600', 600". Said output signals 512, 512', 512" act as input to a third signal adder 636 which provides as output a signal 638 representative of the total mass flow rate capacity of all overfire air dampers 626, 626', 626". Said output signal 638 then acts as input to a second low signal selector 640 which also accepts as input that signal 228 originating from the stoichiometry subsystem 200 and is representative of the mass flow rate of overfire air required to maintain the main burner zone stoichiometric ratio, $\phi_{mbz}$. The second low signal selector 640 thus provides as output a signal 228' which is the lesser of the two input signals and still representative of $\phi_{mbz}$ such that the mass flow rate demand does not exceed the maximum mass flow rate capacity of all dampers 626, 626', 626".

Figure 9:
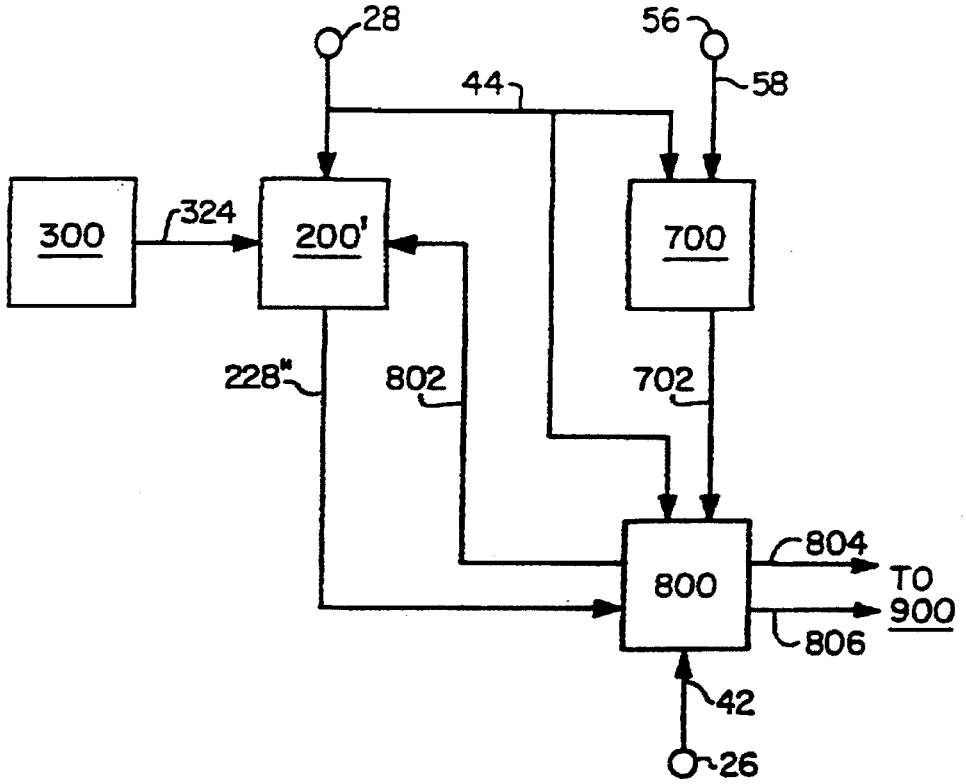
FIG. 9 ms a schematic representation of an alternative configuration of the stoichiometry subsystem constructed in accordance with the present invention.
Figure 10:
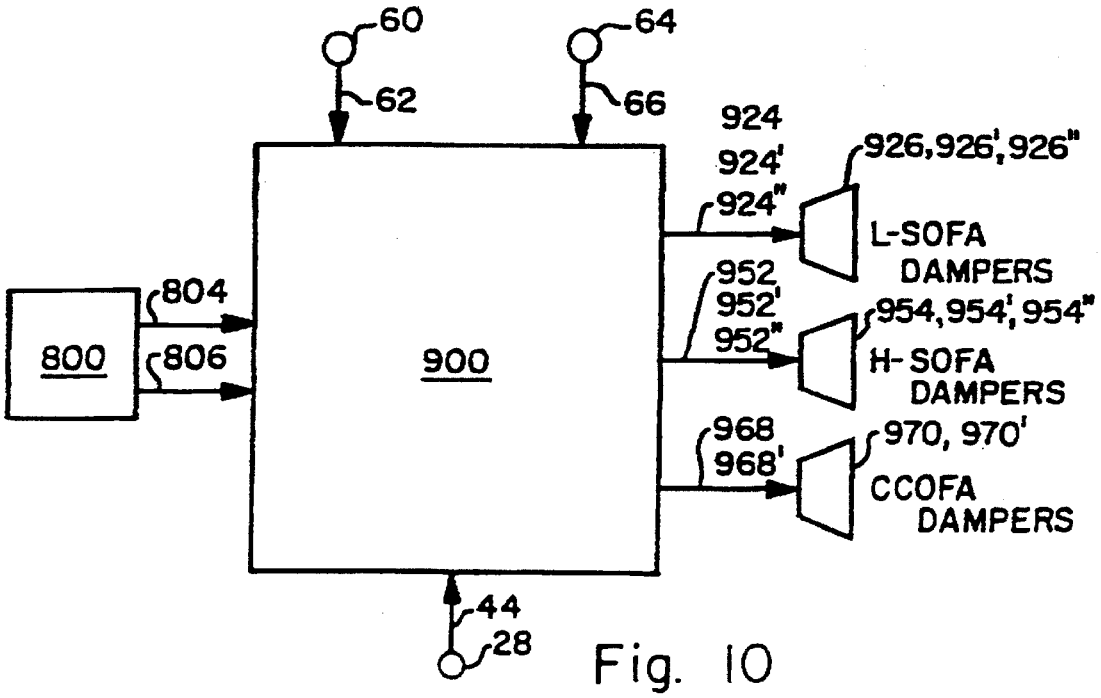
FIG. 10 is a generalized schematic representation of an alternative configuration of the overfire air subsystem constructed in accordance with the present invention.
Figure 11:
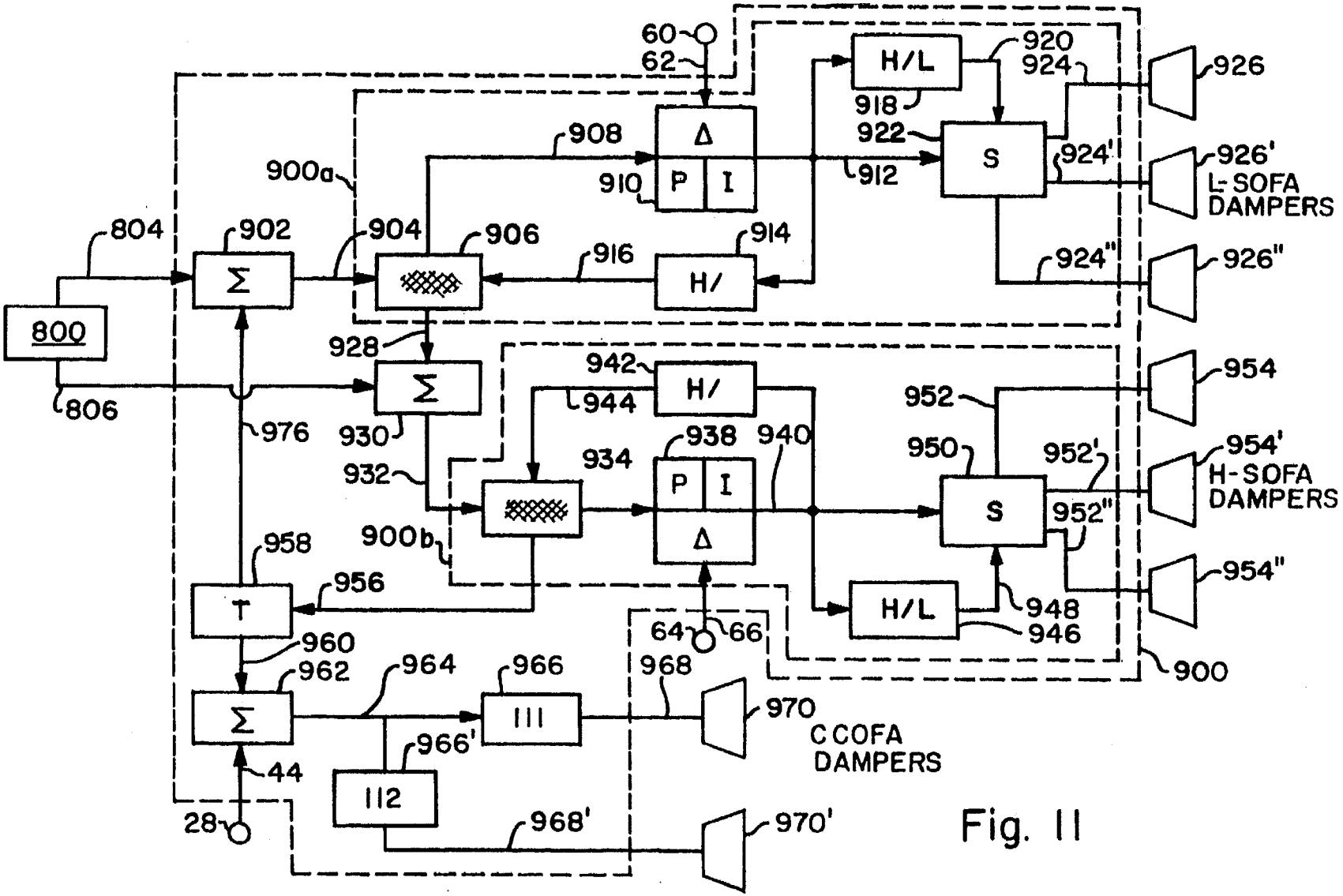
FIG. 11 is a schematic representation of the overfire air subsystem of FIG. 10 constructed in accordance with the present invention.

As a further alternative to apportioning air flow amongst the OFA levels reference is now made to FIGS. 9, 10 and 11. More specifically in FIG. 9 there is depicted the arrangement of the stoichiometry subsystem 200', the override protection subsystem 300, the load change subsystem 700, the dynamic ratio subsystem 800 and their interconnecting signal paths.

Said signal paths are made operable in accordance with conventional practice. It is seen in FIG. 9 that the stoichiometry subsystem 200' is subject to stimulation by signals 44, 324, 802 originating from the unit air flow sensor 28, the override protection subsystem 300, by and the dynamic ratio subsystem 800. Said signals are representative of the total flow of air into the furnace 2, the override protection signal 324 and the stoichiometric ratio of the unit, PHI (unit). Said stoichiometry subsystem 200' is designed and constructed in accordance with the present invention and in a fashion which would be understood by those skilled in the art to provide as output, due to all of said stimulation, a signal 228" which is representative of the mass flow rate of separated overfire air necessary to maintain the main burner zone stoichiometric ratio, $\phi_{mbz}$, and which further acts as one input to the dynamic ratio subsystem 800, later described.

It is also seen in FIG. 9 that the load change subsystem 700 is subject to stimulation by the signal 44 originating from the unit air flow sensor 28 and which is representative of the total flow of air to the furnace 2. The load change subsystem 700 is also subject to stimulation by a signal 58 originating from the fuel sensor 56 and which is representative of the total flow of fuel to the furnace 2. Said load change subsystem 700 is designed and constructed in accordance with the present invention in a fashion which would be understood by those skilled in the art, to provide as output, due to said stimulation, a signal 702 which is representative of the change with respect to time of either the total air flow to the furnace or the total fuel flow to the furnace; whichever is greater. Said output signal 702 thence acts as one input to the dynamic ratio subsystem 800.

It is further seen in FIG. 9 that the dynamic ratio subsystem 800 is subject to stimulation by the signal 44 originating from the air flow sensor 28 and representative of the total air flow to the furnace 2. The dynamic ratio subsystem 800 is also subject to stimulation by a signal 42 originating from the % $O_2$ sensor 26 and representative of percent concentration of oxygen in the combustion exhaust gases. The dynamic ratio subsystem 800 is also subject to stimulation by the signal 228" originating from the stoichiometry subsystem 200' and representative of the mass flow rate of separated overfire air necessary to maintain the main burner zone stoichiometric ratio, $\phi_{mbz}$. The dynamic ratio subsystem 800 is subject to still further stimulation by the signal 702 originating from load change subsystem 700 and representative of the change with respect to time of either the total air flow to the furnace or total fuel flow to the furnace; whichever is greater. Said dynamic ratio subsystem 800 is designed and constructed in accordance with the present invention and in a manner which would be understood by those skilled in the art, to provide as output, due to all of said stimulation, a first signal 802, a second signal 804 and a third signal 806. The first output signal 802 is representative of the unit stoichiometric ratio, PHI (unit), and acts as one input to the stoichiometry subsystem 200', described above. The second output signal 804 is representative of that fraction of the total mass flow rate of air to the furnace allocated to the low SOFA dampers, seen at 926, 926', 926" in FIG. 11, and acts as one input to the overfire air subsystem 900. The third output signal 806 is representative of that fraction of the total mass flow rate of air to the furnace allocated to the high SOFA dampers, seen at 954, 954', 954" in FIG. 11 and also acts as one input to the overfire air subsystem 900.

Referring now to FIG. 10 there is depicted therein a generalized schematic diagram of the overfire air subsystem 900 subject to stimulation by signals 44, 62, 66, 804, 806 originating from an array of sensors 28, 60, 64 as well as the dynamic ratio subsystem 800. Said sensors are strategically located throughout the boiler complex and are in communication by conventional means with the overfire air subsystem 900. The overfire air subsystem 900 is designed and constructed in accordance with the present invention to provide as output, due to all of said stimulation, a set of signals 924, 924', 924", 952, 952', 952", 968, 968' which are representative of the positions of the low SOFA dampers 926, 926', 926" high SOFA dampers 954, 954', 954" and the CCOFA dampers 970, 970' and which position said dampers accordingly.

To further elaborate reference is now made to FIG. 11 wherein there is depicted a more detailed schematic diagram of the overfire air subsystem 900 showing the arrangement of the functional equivalents of its component parts and their interconnecting signal paths. Said components and signal paths are made operable in accordance with conventional practice. The overfire air subsystem 900 is comprised of a first signal adder 902, a second signal adder 930, a third signal adder 962, a first PI controller 910, a second PI controller 938, a first two state signal monitor 914, a second two state signal monitor 942, a first three state signal monitor 918, a second three state signal monitor 946, a first sequencer 922 and a second sequencer 950. Said overfire air subsystem 900 is further comprised of a low SOFA overload circuit 906, a high SOFA overload circuit 934, a signal transfer device 958 and a first signal generator 966.

It is further seen in FIG. 11 that the first signal adder 902 accepts as input first that signal 804 originating from the dynamic ratio subsystem 800 which is representative of the desired fraction of the total mass flow rate of air to the furnace to be allocated to the low SOFA dampers 926, 926', 926"; and secondly that signal 976 originating from the signal transfer device 958 which is representative of the overload in mass flow rate of air suffered by the high SOFA dampers 954, 954', 954". Said first signal adder 902 then provides as output a signal 904 which is representative of the desired total mass flow rate of air to be allocated to the low SOFA dampers 926, 926', 926" and which further acts as one input to the low SOFA overload circuit 906. Said low SOFA overload circuit 906 also accepts as input a feedback signal 916, later described, and provides as output a first signal 908 which is representative of the desired mass flow rate of air to be delivered to the low SOFA dampers 926, 926', 926"; and a second signal 928 which is representative of the overload in mass flow rate of air suffered by the low SOFA dampers 926, 926', 926". Said first signal output 908 acts as one input to the PI controller 910 which is also subject to stimulation by that signal 62 originating from the low SOFA airflow sensor 60 and representative of the actual mass flow rate of air delivered to the low SOFA dampers 926, 926', 926". Said PI controller 910 acts upon the aforesaid input signals 62, 908 in a fashion that would be understood by those skilled in the art so as to provide as output a capacity error signal 912 which acts as input first in feedback to the first two state signal monitor 914, secondly in feedforward to the first three state signal monitor 918 and thirdly to the first sequencer 922. Said capacity error signal 912 is of such a character that when the actual mass flow rate of air delivered to the low SOFA dampers 926, 926', 926" is less than the desired mass flow rate of air, the capacity error signal 912 is an increasing signal. Furthermore, when the actual mass flow rate of air delivered to the low SOFA dampers 926, 926', 926" is equal to the desired mass flow rate of air, within specified limits, the capacity error signal remains constant. Finally, when the actual mass flow rate of air delivered to the low SOFA dampers 926, 926', 926" is greater than the desired mass flow rate of air the capacity error signal 912 is a decreasing signal.

The first two state signal monitor 914 is made operable such that an input signal 912 with a value, $V_1$, less than a predetermined value, $V_0$, generates no output signal 916 and thus the low SOFA overload circuit 906 generates no overload signal 928. An input signal 912 with a value, $V_2$, greater than or equal to $V_0$ generates an output signal 916 which acts as one input to the low SOFA overload circuit 906. The low SOFA overload circuit then generates an overload signal 928 which acts as one input to the second signal adder 930, later described. As a consequence, that amount of air in excess of the capacity of the low SOFA dampers 926, 926', 926" is then shifted to the high SOFA dampers 954, 954', 954".

Continuing now with the first signal sequencer 922 it is seen that it accepts as input a first signal 912, described above and again below, and a second signal 920, later described, which originates from the first three state signal monitor 918. The first signal sequencer 922 provides as output multiple signals 924, 924', 924" which activate the low SOFA dampers 926, 926', 926" and position them so as to maintain the main burner zone stoichiometric ratio, $\phi_{mbz}$. The number of output signals depends upon the number of low SOFA dampers, i.e. each output signal 924, 924', 924" is dedicated to a single damper 926, 926', 926".

The purpose of the first signal sequencer 922 is to open and close the low SOFA dampers in a predetermined order.

The first three state signal monitor 918 is made operable such that an input position error signal 912 with a value, $V_3$, lying between a predetermined lower and upper limit generates no output signal 920. Under these circumstances the sequencer 922 maintains the low SOFA dampers in their current status, i.e. opened or closed. If the input signal 912 has a value, $V_4$, which is less than the aforesaid lower limit an output signal 920 is generated which acts as one input to the first signal sequencer 922. Under these circumstances the sequencer 922 closes the low SOFA dampers in a predetermined order such as from top to bottom. Furthermore, if the input signal 912 has a value, $V_5$, which is greater than the aforesaid upper limit an output signal 920 is generated which acts as one input to the first signal sequencer 922. Under these circumstances the sequencer 922 opens the low SOFA dampers in a predetermined order, such as from bottom to top. The first signal sequencer 922 accepts as input the position error signal 912 concurrent with the output signal 920 originating from the first three state signal monitor 918. When the position error signal 912 is increasing it acts to more fully open the low SOFA dampers 926, 926', 926". When said signal 912 is constant no corrective action is taken with respect to the low SOFA dampers and when said signal 912 is decreasing it acts to more fully close the low SOFA dampers.

Continuing further in FIG. 11 it is seen that the low SOFA overload signal 928 which originates from the low SOFA overload circuit 906 and is representative of the overload in mass flow rate of air suffered by the low SOFA dampers 926, 926', 926" acts as one input to the second signal adder 930. Said signal adder also accepts as input that signal 806 which originates from the dynamic ratio subsystem 800 and is representative of the desired fraction of the total mass flow rate of air to the furnace allocated to the high SOFA dampers 954, 954', 954". The second signal adder 930 then provides as output a signal 932 which is representative of the desired mass flow rate of air to be allocated to the high SOFA dampers 954, 954', 954".

In continuing the explanation of the operative nature of the overfire air subsystem 900 reference is now made in FIG. 11 to the high SOFA control boundary designated by the reference numeral **900*b*. Said control boundary 900*b* encloses the high SOFA overload circuit 934, the second PI controller 938, the second three state signal monitor 946, the second signal sequencer 950 and the second two state signal monitor 942 as well as their interconnecting signal paths 936, 940, 944, 948. It can be seen that said components and signal paths enclosed within the high SOFA control boundary 900b are identical in function and arrangement to those components and signal paths enclosed by the low SOFA control boundary designated by the reference numeral 900*a*. More specifically, those signals 932, 66 entering the high SOFA control boundary 900*b* are analogous to those signals 904, 62 entering the low SOFA control boundary 900*a*. In particular, that signal 932 which is representative of the desired total mass flow rate of air allocated to the high SOFA dampers is analogous to that signal 904 which is representative of the desired mass flow rate of air allocated to the low SOFA dampers. Also, that signal 66 which originates from the high SOFA air flow sensor 64 and is representative of the actual mass flow rate of air delivered to the high SOFA dampers is analogous to that signal 62 which is representative of actual mass flow rate of air delivered to the low SOFA dampers. Furthermore, those signals 952, 952', 952", 956 exiting the high SOFA control boundary 900*b* are analogous to those signals 924, 924', 924", 928 exiting the low SOFA control boundary 900*a*. In particular those signals 952, 952', 952" that originate from the second signal sequencer 950 and which activate the high SOFA dampers 954, 954', 954" and position them accordingly are analogous to those signals 924, 924', 924" described above which activate the low SOFA dampers 926, 926', 926" and position them accordingly. Also, that signal 956 that originates from the high SOFA overload circuit 934 and which is representative of the overload in mass flow rate of air suffered by the high SOFA dampers is analogous to that signal 928 originating from the low SOFA overload circuit 906 and representative of overload in mass flow rate of air suffered by the low SOFA dampers. Thus, the high SOFA dampers 954, 954', 954" are opened, closed and modulated so as to maintain the required main burner zone stoichiometric ratio, $\phi_{mbz}$, in a manner that is functionally identical to that of the low SOFA dampers 926, 926', 926" differing only in the specific nature of activating signals 952, 952', 952", Continuing with reference to FIG. 11 it can be seen therefrom that that signal 956 which originates from the high SOFA overload circuit 934 and is representative of the overload in mass flow rate of air suffered by the high SOFA dampers acts as a sole input to the first signal transfer device 958. Said signal transfer device 958 is made operative by conventional logic and acts to direct the high SOFA overload signal 956 to either the first signal adder 902, described above, or the third signal adder 962, described below, depending upon the available mass flow rate capacity of the low SOFA dampers 926, 926', 926" or of the close coupled OFA dampers 970, 970'. The logic of the signal transfer device 958 preferably is such that priority is given first to the low SOFA dampers and then to the close coupled OFA dampers. Consequently, any overload in mass flow rate of air suffered by the high SOFA dampers is shifted first to the low SOFA dampers 926, 926', 926" thence to the close coupled OFA dampers 970, 970'**.

Figure 16:
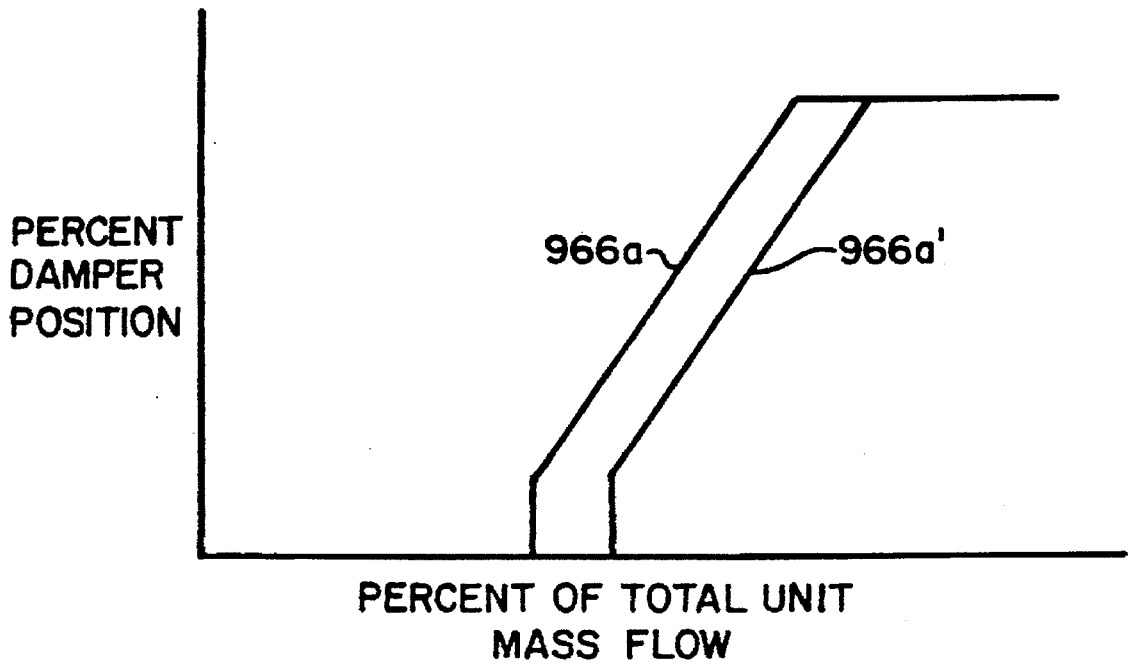
FIG. 16 is a graphical representation of the percent damper opening as a function of total unit air flow.

Continuing with reference to FIG. 11 it is further seen therefrom that the signal transfer device 58 provides as output either a first signal 960 or a second signal 976. The signal 960 directed to the close coupled OFA dampers 970, 970' acts as one input to the third signal adder 962 and is representative of the overload in mass flow rate of air suffered by the high SOFA dampers 954, 954', 954". Said third signal adder 962 also accepts as input that signal 44 which originates from the total air flow sensor 28 and is representative of the total mass flow rate of air delivered to the boiler. Said third signal adder 964 then provides as output that signal 964 which is representative of the percentage of the total mass flow rate of air into the furnace 2 and which acts as input first to the first signal generator 966 and secondly to the second signal generator 966'. The input/output relationship of said signal generators 966, 966' is as generically shown by curves 966*a* and 966'*a* in FIG. 16. Thus, said signal generators 966, 966' provide as output those signals 968, 968' which activate the close coupled OFA dampers and position them accordingly.

While several embodiments of my invention have been shown, it will be appreciated that modifications thereof, some of which have been alluded to hereinabove, may still be readily made thereto by those skilled in the art. I, therefore, intend by the appended claims to cover the modifications which fall within the true spirit and scope of my invention.

What is claimed is:

1. In a fossil fuel-fired furnace having a plurality of walls embodying therewithin a main burner zone, a windbox mounted in supported relation within the main burner zone of the fossil fuel-fired furnace, close coupled overfire air means mounted in the windbox, low separated overfire air means located within the main burner zone of the fossil fuel-fired furnace in spaced relation to the windbox, high separated overfire air located within the main burner zone of the fossil fuel-fired furnace in spaced relation to both the low separated overfire air means and the windbox, means for supplying overfire air to the close coupled overfire air means, the low separated overfire air means and the high separated overfire air means, damper means operative to effect the apportioning of the flow of overfire air amongst the close coupled overfire air means, the low separated overfire air means and the high separated overfire air means, and a firing system operative to effect therewith the combustion within the fossil fuel-fired furnace of fossil fuels such that flue gases are generated as a consequence of the combustion of the fossil fuels, a control system for effecting control over the firing system comprising:

a. means for determining the mass flow rate of the overfire air required to be supplied to the close coupled overfire air means, the low separated overfire air means and the high separated overfire air means in order to maintain a predetermined stoichiometric ration within the main burner zone of the fossil fuel-fired furnace;

b. means for determining the windbox-to-furnace pressure differential within the fossil fuel-fired furnace;

c. means for effecting control over the windbox-to-furnace pressure differential such that the windbox-to-furnace pressure differential maintains precedence over said means for determining the mass flow rate of overfire air supplied to the close coupled overfire air means, the low separated overfire air means and the high separated overfire air means; and d. means for effecting control over the apportioning of the mass flow rate of overfire air amongst the close coupled overfire air means, the low separated overfire air means and the high separated overfire air means.

2. The control system as set forth in claim 1 wherein said means for determining the mass flow rate of overfire air to the close coupled overfire air means, the low separated overfire air means and the high separated overfire air means comprises a stoichiometry subsystem.

3. The control system as set forth in claim 2 wherein said stoichiometry subsystem includes an input signal received thereby representative of the load at which the fossil fuel-fired furnace is being operated, an input signal received thereby representative of the percent of O2 present in the flue gases, an input signal received thereby representative of the total air flow supplied to the fossil fuel-fired furnace and an input signal received thereby from said means for effecting control over the windbox-to-furnace pressure differential.

4. The control system as set forth in claim 3 wherein said stoichiometry subsystem includes an output signal produced thereby representative of the mass flow rate of overfire air required to be supplied to the close coupled overfire air means, the low separated overfire air means and the high separated overfire air means in order to maintain the predetermined stoichiometric ratio within the main burner zone of the fossil fuel-fired furnace.

5. The control system as set forth in claim 1 wherein said means for effecting control over the windbox-to-furnace pressure differential comprises an override protection subsystem.

6. The control system as set forth in claim 5 wherein said override protection subsystem includes an input signal received thereby from the damper means representative of the positions occupied by the damper means.

7. The control system as set forth in claim 6 wherein said override protection subsystem includes an output signal produced thereby for ensuring that said override protection subsystem maintains precedence over said stoichiometry subsystem.

8. The control system as set forth in claim 1 wherein said means for effecting control over the apportioning of the mass flow rate of overfire air amongst the close coupled overfire air means, the low separated overfire air means and the high separated overfire air means comprises an overfire air subsystem.

9. The control system as set forth in claim 8 wherein said overfire air subsystem includes a multiplicity of input signals received thereby representative of windbox pressure, a multiplicity of input signals received thereby representative of windbox temperature, a multiplicity of input signals received thereby representative of the fossil fuel-fired furnace pressure, an input signal received thereby representative of the total mass flow rate of overfire air through the damper means to the low separated overfire air means and through the damper means to the high separated overfire air means, and an input signal received thereby representative of the mass flow rate of overfire air required to be supplied to the close coupled overfire air means, the low separated overfire air means and the high separated overfire air means in order to maintain the predetermined stoichiometric ratio within the main burner zone of the fossil fuel-fired furnace.

10. The control system as set forth in claim 9 wherein said overfire air subsystem includes a multiplicity of output signals produced thereby representative of the position required to be occupied by the damper means relative to the close coupled overfire air means in order to maintain the predetermined stoichiometric ratio within the main burner zone of the fossil fuel-fired furnace, a multiplicity of output signals produced thereby representative of the position required to be occupied by the damper means relative to the low separated overfire air means in order to maintain the stoichiometric ratio within the main burner zone of the fossil fuel-fired furnace and a multiplicity of output signal produced thereby representative of the position required to be occupied by the damper means in order to maintain the predetermined stoichiometric ratio within the main burner zone of the fossil fuel-fired furnace.

11. The control system as set forth in claim 8 wherein said overfire air system further includes a damper control subsystem.

12. The control system as set forth in claim 11 wherein said damper control subsystem includes an input signal received thereby representative of windbox pressure, an input signal received thereby representative of windbox temperature, an input signal received thereby representative of the fossil fuel-fired furnace pressure and an input signal received thereby of the mass flow rate of overfire air allocated to at least one selected from the close coupled overfire air means, the low separated overfire air means and the high separated overfire air means.

13. The control system as set forth in claim 2 wherein said damper control subsystem includes an output signal produced thereby representative of error in the mass flow rate of overfire air flowing through the damper means to at least one selected from the close coupled overfire air means, the low separated overfire air means and the high separated overfire air means and a multiplicity of output signals produced thereby representative of the respective positioning of the damper means relative to at least one of the close coupled overfire air means, the low separated overfire air means and the high separated overfire air means.

14. The control system as set forth in claim 1 wherein said control means further comprises means for determining the extent to which the damper means is required to be open relative to at least one selected from the close couple overfire air means, the low separated overfire air means and the high separated overfire air means in order to maintain the stoichiometric ratio within the main burner zone of the fossil fuel-fired furnace.

15. The control means as set forth in claim 14 wherein said means for determining the extent to which the damper means is required to be open includes an input signal received thereby representative of the load at which the fossil fuel-fired furnace is being operated relative to the maximum continuous load at which the fossil fuel-fired furnace is capable of being operated, an input signal received thereby representative of the mass flow rate of overfire air required to be supplied to the close coupled overfire air means, the low separated overfire air means and the high separated overfire air means in order to maintain the predetermined stoichiometric ratio within the main burner zone of the fossil fuel-fired furnace and an input signal received thereby representative of error in the mass flow rate of overfire air flowing through the damper means to at least one selected from the close coupled overfire air means.

16. The control system as set forth in claim 15 wherein said means for determining the extent to which the damper means is required to be open includes an output signal produced thereby representative of the maximum mass flow rate of overfire air capable of passing through the damper means to at least one selected from the close coupled overfire air means, the low separated overfire air means and the high separated overfire air means, an output signal produced thereby representative of that portion of the total mass flow rate of overfire air flowing through the damper means relative to at least one selected from the close coupled overfire air means, the low separated overfire air means and the high separated overfire air means and an output signal produced thereby representative of the extent to which the damper means is open relative to at least one selected from the close coupled overfire air means, the low separated overfire air means and the high separated overfire air means.

17. The control system as set forth in claim 1 wherein said means for effecting control over the apportioning of the mass flow rate of overfire air amongst the close coupled overfire air means, the low separated overfire air means and the high separated overfire air means includes an input signal received thereby representative of the portion of the total mass flow rate of overfire air desired to be passed through the damper means to the low separated overfire air means, an input signal received thereby representative of the portion of the total mass flow rate of overfire air desired to be passed through the damper means to the high separated overfire air means, an input means received thereby representative of the actual portion of the total mass flow rate of overfire air passing through the damper means to the low separated overfire air means and an input signal received thereby representative of the actual portion of the total mass flow rate of overfire air passing through the damper means to the high separated overfire air means.

18. The control means as set forth in claim 17 wherein said means for effecting control over the apportioning of the mass flow rate of overfire air amongst the close coupled overfire air means, the low separated overfire air means and the high separated overfire air means includes a multiplicity of output signals produced thereby representative of the position required to be occupied by the damper means relative to the close coupled overfire air means in order to maintain the predetermined stoichiometric ratio within the main burner zone of the fossil fuel-fired furnace and a multiplicity of output signals produced thereby representative of the position required to be occupied by the damper means relative to the low separated overfire air means in order to maintain the predetermined stoichiometric ratio within the main burner zone of the fossil fuel-fired furnace.

19. The control system as set forth in claim 16 wherein said means for effecting control over the apportioning of the mass flow rate of overfire air amongst the close coupled overfire air means, the low separated overfire air means and the high separated overfire air means includes a dynamic ratio subsystem operative for determining the portion of the total mass flow of overfire air apportioned through the damper means to the low separated overfire air means and to the high separated overfire air means and a load change subsystem operative for determining the change with time of the greater as between the total air flow to the fossil fuel-fired furnace and the total fuel flow to the fossil fuel-fired furnace.

* * * * *